US009208721B2

(12) United States Patent
Odawara et al.

(10) Patent No.: US 9,208,721 B2
(45) Date of Patent: Dec. 8, 2015

(54) ORGANIC EL DISPLAY APPARATUS AND METHOD OF FABRICATING ORGANIC EL DISPLAY APPARATUS

(71) Applicant: JOLED INC., Tokyo (JP)

(72) Inventors: Rie Odawara, Kyoto (JP); Yasuo Segawa, Hyogo (JP)

(73) Assignee: JOLED INC., Tokyo (JP)

( * ) Notice: Subject to any disclaimer, the term of this patent is extended or adjusted under 35 U.S.C. 154(b) by 506 days.

(21) Appl. No.: 13/621,351

(22) Filed: Sep. 17, 2012

(65) Prior Publication Data

US 2013/0021389 A1 Jan. 24, 2013

Related U.S. Application Data

(63) Continuation of application No. PCT/JP2011/000844, filed on Feb. 16, 2011.

(30) Foreign Application Priority Data

Mar. 25, 2010 (JP) ..... 2010-070960

(51) Int. Cl.
*H05B 33/10* (2006.01)
*G09G 3/32* (2006.01)

(52) U.S. Cl.
CPC ..... *G09G 3/3233* (2013.01); *G09G 2300/0842* (2013.01); *G09G 2320/029* (2013.01);
(Continued)

(58) Field of Classification Search
CPC ..... G09G 3/30; G09G 5/10; G06F 3/038
USPC ..... 345/690, 212, 76, 78, 82, 83; 313/169.3
See application file for complete search history.

(56) References Cited

U.S. PATENT DOCUMENTS 6,229,508 B1 5/2001 Kane
6,618,030 B2 9/2003 Kane et al.
(Continued)

FOREIGN PATENT DOCUMENTS

JP 11-219146 8/1999
JP 2002-055675 2/2002
(Continued)

OTHER PUBLICATIONS

U.S. Appl. No. 13/621,397 to Rie Odawara et al., filed Sep. 17, 2012.
(Continued)

*Primary Examiner* — Quan-Zhen Wang
*Assistant Examiner* — Yuk Chow
(74) *Attorney, Agent, or Firm* — Greenblum & Bernstein, P.L.C.

(57) ABSTRACT

A method of fabricating an organic EL display apparatus includes: obtaining a representative current (I)-voltage (V) characteristic of a display panel including pixels each having an organic EL device and a driving transistor; dividing the display panel into a plurality of divided regions, and calculating a light-emitting efficiency and a light-emission starting current value for each of the divided regions calculated by a luminance (L)-I characteristic of the divided region; measuring luminance of light emitted from each of the pixels and calculating an L-V characteristic of each of the pixels; calculating an I-V characteristic of each pixel by dividing each luminance value of the L-V characteristic calculated for the pixel by light-emitting efficiency, and by adding a light-emission starting current value; and calculating a correction parameter for each pixel such that the I-V characteristic of each pixel is corrected to the representative I-V characteristic.

16 Claims, 18 Drawing Sheets

(52) U.S. Cl.
CPC ..... *G09G2320/0285* (2013.01); *G09G 2320/0295* (2013.01); *G09G 2320/043* (2013.01); *G09G 2360/145* (2013.01); *G09G 2360/147* (2013.01)

(56) References Cited

U.S. PATENT DOCUMENTS

| | | | | |
|---|---|---|---|---|
| 6,791,566 | B1 | 9/2004 | Kuratomi et al. | |
| 7,518,621 | B2 | 4/2009 | Kinoshita et al. | |
| 7,623,108 | B2 | 11/2009 | Jo et al. | |
| 7,834,825 | B2 | 11/2010 | Mizukoshi et al. | |
| 7,859,492 | B2 | 12/2010 | Kohno | |
| 8,059,070 | B2 | 11/2011 | Odawara et al. | |
| 8,841,848 | B2 * | 9/2014 | Ogata et al. ..... | H05B 33/0818 315/169.3 |
| 2001/0024186 | A1 | 9/2001 | Kane et al. | |
| 2002/0101395 | A1 * | 8/2002 | Inukai ..... | G09G 3/3258 345/83 |
| 2003/0142048 | A1 * | 7/2003 | Nishitani et al. ..... | G09G 3/3258 345/82 |
| 2005/0195178 | A1 | 9/2005 | Jo et al. | |
| 2006/0214940 | A1 | 9/2006 | Kinoshita et al. | |
| 2006/0284802 | A1 | 12/2006 | Kohno | |
| 2007/0008251 | A1 * | 1/2007 | Kohno et al. ..... | 345/76 |
| 2007/0210996 | A1 | 9/2007 | Mizukoshi et al. | |
| 2009/0179831 | A1 * | 7/2009 | Yamashita et al. ..... | 345/76 |
| 2010/0156766 | A1 * | 6/2010 | Levey et al. ..... | 345/78 |
| 2010/0253715 | A1 | 10/2010 | Odawara et al. | |

FOREIGN PATENT DOCUMENTS

| | | |
|---|---|---|
| JP | 2005-250121 | 9/2005 |
| JP | 2005-283816 | 10/2005 |
| JP | 2005-284172 | 10/2005 |
| JP | 2006-349966 | 12/2006 |
| JP | 2007-018876 | 1/2007 |
| JP | 2010-134169 | 6/2010 |
| JP | 2010-256783 | 11/2010 |
| WO | 2004/086345 | 10/2004 |
| WO | 2005/101360 | 10/2005 |
| WO | 2009/144936 | 12/2009 |

OTHER PUBLICATIONS

International Search Report in International Application No. PCT/JP2011/000844, dated May 10, 2011.

* cited by examiner

FIG. 6
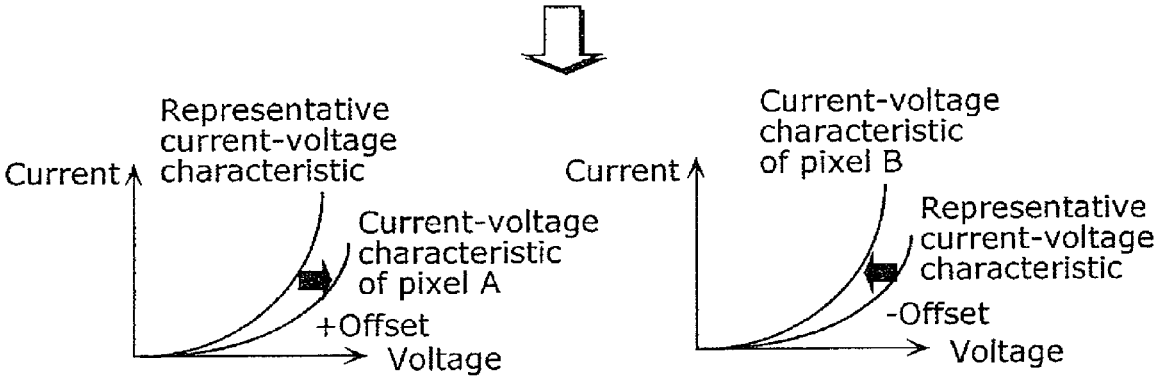
(e) Calculate correction parameter for each pixel
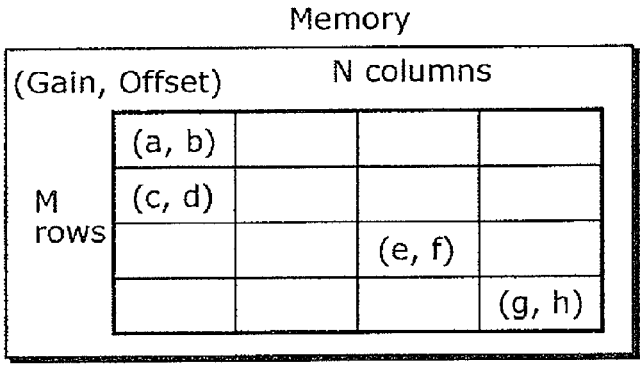
(f) Write correction parameter on memory

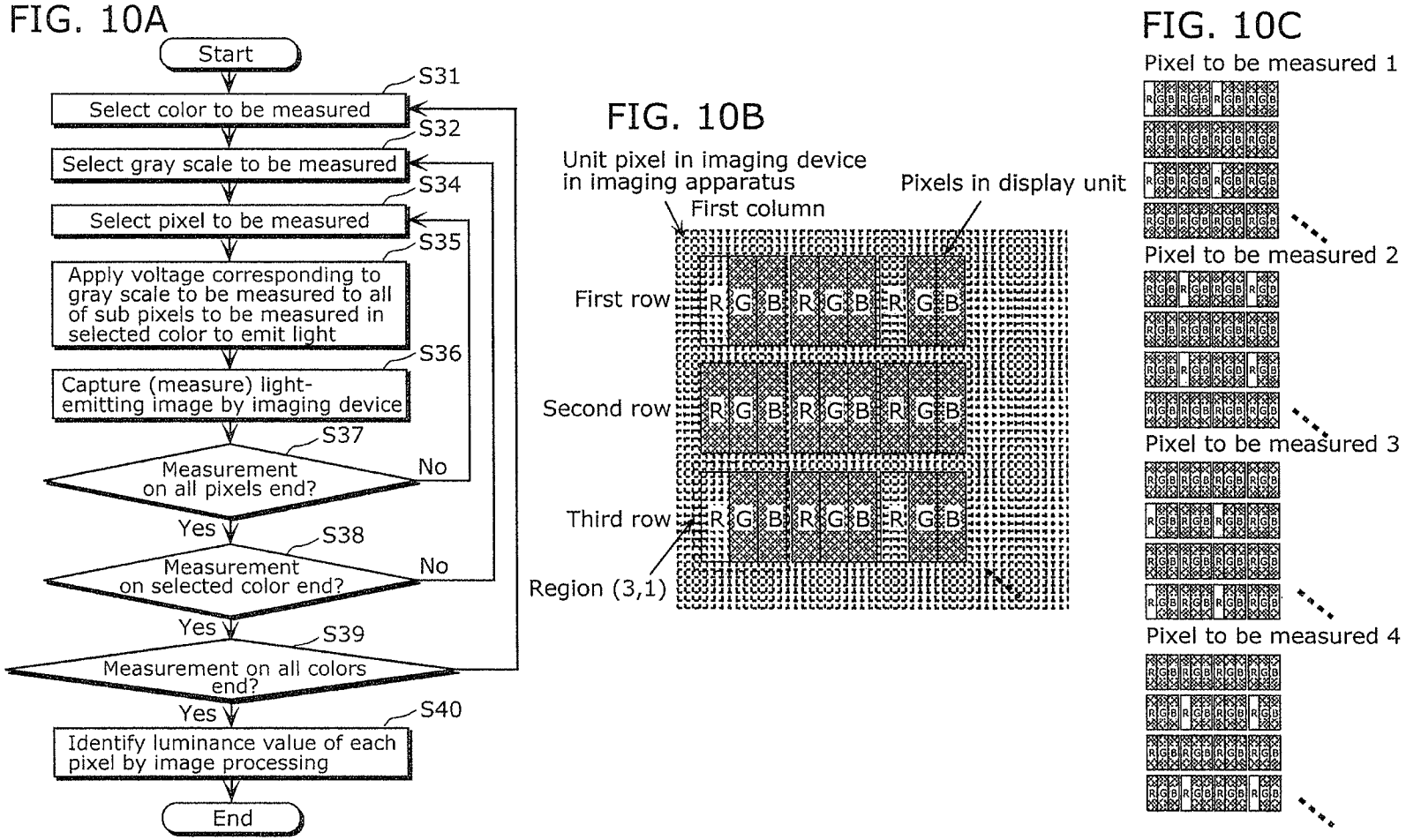
FIG. 10A
Start
Select color to be measured
S31
Select gray scale to be measured
S32
Select pixel to be measured
S34
Apply voltage corresponding to gray scale to be measured to all of sub pixels to be measured in selected color to emit light
S35
Capture (measure) light-emitting image by imaging device
S36
Measurement on all pixels end?
S37
No
Yes
Measurement on selected color end?
S38
No
Yes
Measurement on all colors end?
S39
Yes
Identify luminance value of each pixel by image processing
S40
End
FIG. 10B
Unit pixel in imaging device in imaging apparatus
Pixels in display unit
First column
First row
Second row
Third row
Region (3,1)
FIG. 10C
Pixel to be measured 1
Pixel to be measured 2
Pixel to be measured 3
Pixel to be measured 4

| Divided region | Reciprocal of light-emitting efficiency (r) | Light-emission starting current (s) |
|---|---|---|
| 1 | 10 | +2 |
| 2 | 8 | +5 |
| 3 | 14 | +3 |
| 4 | 2 | +4 |

When calculating voltage gain and offset

When calculating current gain only

When light-emitting layer is formed by vapor deposition

When light-emitting layer is formed by inkjet printing

ORGANIC EL DISPLAY APPARATUS AND METHOD OF FABRICATING ORGANIC EL DISPLAY APPARATUS

CROSS REFERENCE TO RELATED APPLICATION

This is a continuation application of PCT application No. PCT/JP2011/000844 filed on Feb. 16, 2011, designating the United States of America.

BACKGROUND OF THE INVENTION (1) Field of the Invention

The present invention relates to organic EL display apparatuses and methods of fabricating organic EL display apparatuses, and particularly relates to an active-matrix organic EL display apparatus and a method of fabricating the active-matrix organic EL display apparatus.

(2) Description of the Related Art

An image display apparatus using organic EL devices (organic EL display) has been known as an image display apparatus using current-driven light-emitting devices. The organic EL display has been attracting attention as a possible next-generation Flat Panel Display (FPD) for its advantages including wide viewing angles and small power consumption.

In an organic EL display, the organic EL devices composing pixels are usually arranged in a matrix. An organic EL display in which organic EL devices are provided at cross-points of row electrodes (scanning lines) and column electrodes (data lines), and the organic EL devices are driven by applying voltage corresponding to data signal between a selected row electrode and column electrodes is referred to as a passive-matrix organic EL display.

In contrast, an organic EL display in which thin film transistors (TFT) are provided at cross-points of the scanning lines and the data lines, a gate of a driving transistor is connected to the TFT, the data signal input is provided to the driving transistor by turning on the TFT through the selected scanning line, and the organic EL devices are driven by the driving transistors. Such an organic EL display is referred to as an active-matrix organic EL display.

In contrast with the passive-matrix organic EL display in which the organic EL devices connected to each row electrode (scanning line) emit light only when the row electrode is selected, in the active-matrix organic EL display, the organic EL devices can emit light until next scanning (selection). Accordingly, even when the duty cycle increases, the luminance of the display does not decrease. Thus, the display can be driven by low voltage, reducing the power consumption. However, due to variation in the characteristics of the driving transistors and the organic EL devices, the active-matrix organic EL display has a disadvantage that the luminance is uneven because luminance of the organic EL device in each pixel is different even when the same data signal is given.

Typical methods of compensating the unevenness in luminance due to variation in the characteristics (hereafter referred to as uneven characteristics) of the driving transistors and organic EL device caused by the fabricating process in the conventional organic EL display include compensation by complex pixel circuits and compensation using an external memory.

However, the complex pixel circuits decreases yield. In addition, the complex pixel circuits do not compensate the unevenness in the light-emitting efficiency of the organic EL device in each pixel.

For the reasons described above, several methods of compensating the unevenness in the characteristics of the pixels by the external memory have been proposed.

For example, according to the electric optical device, the method of driving the electric optical device, the method of fabricating the electric optical device, and the electronic device according to Patent Literature 1: Japanese Unexamined Patent Application Publication No. 2005-283816, in a current program pixel circuit, the luminance of each pixel is measured by at least one type of input current, and the measured luminance ratio of each pixel is stored in the storage capacitance, the image data is corrected based on the luminance ratio, and the current program pixel circuit is driven by the image data after the correction. With this, the unevenness in luminance is suppressed, allowing a uniform display.

SUMMARY OF THE INVENTION

However, with the solution described above, early measurement of the luminance and the current is necessary for compensating the uneven luminance using the external memory.

When performing the early measurement on the current and correcting the uneven luminance, it is necessary to take a long time for the early measurement in order to measure the desired current highly precisely considering the parasitic capacitance of the entire circuit and the line resistance. Accordingly, there is a problem that the fabricating cost increases when the uneven luminance is compensated while maintaining the precision of the correction. In particular, the larger the panel screen and the more the number of input gray-scales, it takes longer to measure the entire surface of the panel. As a result, there is a problem that the fabricating cost is significantly increased.

Alternatively, when the uneven luminance is corrected by the early measurement of the luminance with respect to the voltage input, instead of the early measurement of the current in each pixel, the variations in both the driving transistors and the organic EL devices are measured, allowing the correction of both of the variations at once.

FIG. 18 is a diagram for illustrating an example of the conventional correction method in for the organic EL display. Before correction, the organic EL display has a luminance distribution reflecting both the luminance distribution due to the organic EL device and the luminance distribution due to the driving transistors. In contrast, with the conventional correction method for measuring luminance with respect to a voltage input, both the variations in the organic EL devices and the variations in the driving transistors are corrected. Accordingly, the organic EL display after correction has a uniform luminance distribution. However, in order to obtain the uniform luminance distribution, the currents flowing in the organic EL devices differ from pixel to pixel. In this case, the current load on the organic EL device differ for each pixel, accelerating the variation in the degradation of luminance due to the product life of the organic EL devices, triggering the uneven luminance due to change over time.

In view of the problems above, it is an object of the present invention to provide an organic EL display apparatus and the method of fabricating the organic EL display apparatus capable of reducing the manufacturing cost for generating the uneven luminance correcting parameter and suppressing the uneven luminance due to the change over time.

In order to solve the problems described above, the organic EL display apparatus according to an aspect of the present invention is a method of fabricating an organic EL display apparatus, including: obtaining a representative current-voltage characteristic common to an entire display panel including a plurality of pixels each having a light-emitting device and a driving device which is voltage-driven and controls a current supply to the light-emitting device; dividing the display panel into a plurality of divided regions, applying voltage to the driving device in each of the pixels, measuring a current flowing in each of the divided regions and luminance of light emitted from the divided region when the current is flowing in the divided region, calculating a luminance-current characteristic of the divided region according to the measured current flowing in the divided region and the measured luminance of the light emitted from the divided region, and calculating a light-emitting efficiency and a light-emission starting current value for each of the divided regions, the light-emitting efficiency being a reciprocal of a slope of the luminance-current characteristic, and the light-emission starting current value being an intercept of a current axis of the luminance-current characteristic; measuring luminance of light emitted from each of the pixels in the display panel by a predetermined measuring device and calculating a luminance-voltage characteristic of each of the pixels according to the measured luminance of the light emitted from the pixel; calculating a current-voltage characteristic of each pixel by dividing each luminance value of the luminance-voltage characteristic calculated for the pixel by light-emitting efficiency of a divided region to which the pixel belongs, and by adding, to the divided value, a light-emission starting current value of the divided region to which the pixel belongs; and calculating a correction parameter for a target pixel such that the current-voltage characteristic of the target pixel calculated in the calculating of a current-voltage characteristic of each pixel is corrected to the representative current-voltage characteristic.

According to the organic EL display apparatus and the method of manufacturing the organic EL display apparatus, the current load of the organic EL devices having a product life dependent on the light-emitting current is set to be equal from pixel to pixel. Therefore, it is possible to suppress the degradation in luminance caused by the product life.

Furthermore, upon generating the correction parameter, it is not necessary to measure the current of each pixel. Thus, it is possible to reduce the time necessary for measurement for generating the correction parameter, and the fabrication cost can be reduced.

FURTHER INFORMATION ABOUT TECHNICAL BACKGROUND TO THIS APPLICATION

The disclosure of Japanese Patent Application No. 2010-070960 filed on Mar. 25, 2010 including specification, drawings and claims is incorporated herein by reference in its entirety.

The disclosure of PCT application No. PCT/JP2011/000844 filed on Feb. 16, 2011, including specification, drawings and claims is incorporated herein by reference in its entirety.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings:

FIG. 6 illustrates charts for illustrating characteristics obtained by the third process group in the method of fabricating the organic EL display device according to Embodiment 1 of the present invention;

FIG. 10A is an operational flowchart illustrating the second specific method for obtaining the L-V characteristics of each pixel;

FIG. 10B is a diagram for illustrating a captured image when calculating the L-V characteristics of each pixel;

FIG. 10C is a state transition diagram of the measured pixels that are selected;

DESCRIPTION OF THE PREFERRED EMBODIMENT(S)

Figure 1:
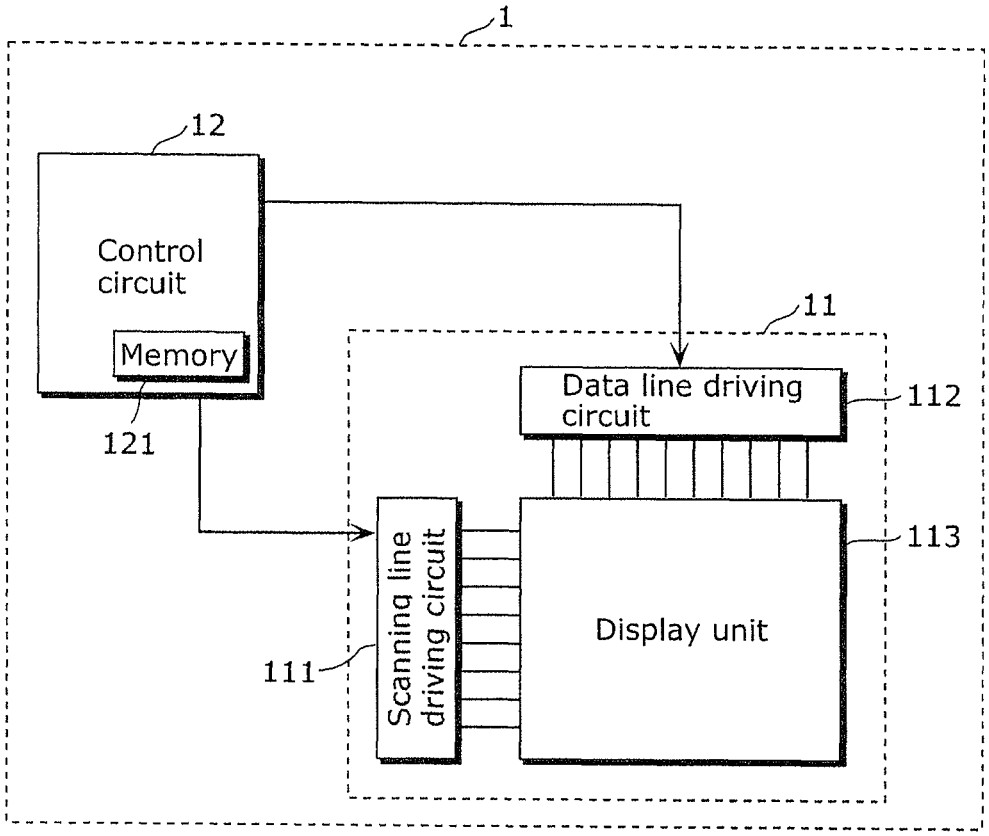
FIG. 1 is a block diagram illustrating an electric configuration of the organic EL display apparatus according to Embodiment of the present invention.

The method of fabricating an organic EL display apparatus according to an aspect of the present invention includes obtaining a representative current-voltage characteristic common to an entire display panel including a plurality of pixels each having a light-emitting device and a driving device which is voltage-driven and controls a current supply to the light-emitting device; dividing the display panel into a plurality of divided regions, applying voltage to the driving device in each of the pixels, measuring a current flowing in each of the divided regions and luminance of light emitted from the divided region when the current is flowing in the divided region, calculating a luminance-current characteristic of the divided region according to the measured current flowing in the divided region and the measured luminance of the light emitted from the divided region, and calculating a light-emitting efficiency and a light-emission starting current value for each of the divided regions, the light-emitting efficiency being a reciprocal of a slope of the luminance-current characteristic, and the light-emission starting current value being an intercept of a current axis of the luminance-current characteristic; measuring luminance of light emitted from each of the pixels in the display panel by a predetermined measuring device and calculating a luminance-voltage characteristic of each of the pixels according to the measured luminance of the light emitted from the pixel; calculating a current-voltage characteristic of each pixel by dividing each luminance value of the luminance-voltage characteristic calculated for the pixel by light-emitting efficiency of a divided region to which the pixel belongs, and by adding, to the divided value, a light-emission starting current value of the divided region to which the pixel belongs; and calculating a correction parameter for a target pixel such that the current-voltage characteristic of the target pixel calculated in the calculating of a current-voltage characteristic of each pixel is corrected to the representative current-voltage characteristic.

When calculating the luminance-voltage characteristic of each pixel by measuring the luminance of light emitted from each pixel included in the display panel, the luminance-voltage characteristic of each pixel reflects both the variations in the light-emitting device and a TFT which is the driving device for driving the light-emitting device included in each pixel.

When the correction parameter for correcting both the variations in the light-emitting devices and the variations in the TFTs, and the video signal from outside is corrected using the correction parameter, the correction includes a correction for the variations in the light-emitting devices. Accordingly, with this correction, the luminance of the light emitted from the light-emitting device is uniform with respect to the video signal in the same gray-scale for the entire display panel.

However, due to the variations in the characteristics of the light-emitting devices, the luminance of each light-emitting device differs when the same current flows. Thus, when the correction for making the luminance of the light-emitting devices uniform for the entire display panel is performed, the amount of current flowing in each light-emitting device differs from the light-emitting device to the light-emitting device. In this case, since the product life of the light-emitting device depends on the amount of current, the product life of each light-emitting device differ as the time passes. The variation in product life of each light-emitting device consequently appears as uneven luminance on screen.

Accordingly, in this aspect, only the variations in TFTs are mainly corrected, and the amount of the current flowing in each light-emitting device is uniform for the video signal with the same gray-scale for the entire display panel. This is because, although the variations in the TFTs are large, the variations in the light-emitting devices are very small among the light-emitting devices, and thus correcting only the variations in the TFTs enables displaying of a uniform image to human eye without correcting variations in the light-emitting devices.

In this aspect, first, the representative current-voltage characteristic common to all of the pixels in the display panel is set. Next, the luminance when the current flows in the divided region is measured for each divided region, and the light-emitting efficiency and the light-emission starting current value of each divided region are calculated. Here, the light-emission starting current value is a current value at which the organic EL device starts emitting light. More specifically, the variations in the light-emitting devices are determined based on the difference in the light-emitting efficiencies and the light-emission starting current value of the divided regions.

Next, the luminance of the light emitted from each pixel included in the display panel is measured by the predetermined measuring device, and the luminance-voltage characteristic of each pixel is calculated.

Subsequently, the luminance value in the luminance-voltage characteristic of each measured pixel is divided by the light-emitting efficiency of the divided region to which the pixel belongs, and to the divided value, the light emission starting current value of the divided region to which the pixel belongs is added, so as to calculate the current-voltage characteristic of each pixel.

After that, the correction parameter for correcting the current-voltage characteristic of each pixel to the representative current-voltage characteristic is calculated. With this, the current-voltage characteristic of each divided region is corrected to the representative current-voltage characteristic common to the entire display panel.

More specifically, the current-voltage characteristic of the target pixel calculated by using the luminance-voltage characteristic of each pixel and the light-emitting efficiency and the light-emission starting current value for each of the divided region is a characteristic including the variation in the light-emitting device that is measured. Accordingly, calculating the correction parameter for correcting the current-voltage characteristic of the target pixel to the representative current-voltage characteristic is calculating a correction parameter for mainly correcting the variation in the TFT, which barely includes the variation in the light-emitting device. In other words, the correction parameter for correcting the variation in the TFT excluding the variation in the light-emitting devices is calculated.

With this, it is possible to set a constant current flowing in each light-emitting device for the same specified gray-scale, making the current load constant between the light-emitting devices. Thus, it is possible to set a current flowing in each light-emitting device uniform, suppressing the variation in the product life of the light-emitting devices as time passes. As a result, it is possible to prevent the uneven luminance due to the variations in the product life of the light-emitting devices from appearing on screen.

Furthermore, in this aspect, in order to obtain the correction parameter for correcting the variation in TFT, the luminance-voltage characteristic including both the variation in the light-emitting device and the variation in the TFT in each pixel and the light-emitting efficiency and the light-emission starting current value of the light-emitting devices in each divided region are measured, instead of measuring the variations in the TFTs in the pixels themselves. More specifically, the light-emitting efficiency and the light-emission starting current value of each divided region is calculated by dividing the display panel into multiple divided regions, and measuring the current flowing in the divided region and the luminance of the divided region when the current is flowing in the divided region. In other words, by calculating the light-emitting efficiency and the light-emission starting current value of each divided region, it is possible to find out the variations in the light-emitting devices between the divided regions. This is because the light-emitting devices vary for a certain region, rather than for a pixel. Furthermore, the luminance-voltage characteristics for multiple pixels can be measured at the same time by using a CCD camera, for example. With this, compared to the case in which the variation in the TFT is measured by applying voltage to each pixel, and measuring the current flowing in each pixel, it is possible to significantly reduce the time for measuring the correction parameter. Furthermore, by not forcefully correcting the luminance inclination which does not bother the user, the power consumption can also be reduced.

In the method of fabricating an organic EL display apparatus according to an aspect of the present invention, it is preferable that the measuring of luminance of the light emitted from the pixel includes; applying a predetermined voltage to the pixels included in the display panel such that the pixels emit light simultaneously; and capturing, by a predetermined measuring device, the light simultaneously emitted from the pixels; and in the calculating of a luminance-voltage characteristic, an image obtained by the capturing is obtained, luminance of each of the pixels is determined from the obtained image, and the luminance-voltage characteristic of each of the pixels is calculated using the predetermined voltage and the determined luminance of the pixel.

According to this aspect, when obtaining the luminance-voltage characteristic for each pixel, the light simultaneously emitted from all of the pixels in the light-emitting panel is captured at one time, without capturing light emitted from each pixel by applying the predetermined voltage. Subsequently, based on the captured image, the luminance of the light emitted from each pixel is determined by image processing separating the light emitted from each pixel. Accordingly, the time for capturing image is significantly reduced. Thus, it is possible to significantly simplify the process for obtaining the luminance-voltage characteristic for each pixel defined in the step above.

In the method of fabricating an organic EL display apparatus according to an aspect of the present invention, it is preferable that the predetermined measuring device is an image sensor.

According to this aspect, the image of light emitted from all of the pixels can be obtained at low noise, high sensitivity, and high resolution. Thus, it is possible to obtain highly precise luminance-voltage characteristic of each pixel by image processing for separating the light emitted from each pixel.

In the method of fabricating an organic EL display apparatus according to an aspect of the present invention, in the calculating of a current-voltage characteristic of each pixel, a position of the target pixel in the display panel may be determined, and when the target pixel is located near a boundary with another neighboring divided region which does not include the target pixel, the light-emitting efficiency and the light-emission starting current value of the target pixel may be calculated by weighting the light-emitting efficiency and the light-emission starting current value of the divided region which includes the target pixel and the light-emitting efficiency and the light-emission starting current value of the other neighboring divided region at a predetermined ratio, and the current-voltage characteristic of each pixel may be calculated by dividing the luminance value of the luminance-voltage characteristic of each pixel by the light-emitting efficiency of the target pixel, and by adding the light-emission starting current value of the target pixel to the divided value, in the calculating of a correction parameter, a correction parameter for the target pixel may be calculated such that the current-voltage characteristic of the target pixel calculated in the calculating of a current-voltage characteristic of each pixel is corrected to the representative current-voltage characteristic.

When the correction parameter for each pixel included in the divided region is calculated using only the light-emitting efficiency of the divided region, and the video signal for each pixel is corrected, the target luminance-voltage characteristic is different for each divided region. Thus, there may be a possibility that the boundaries of the divided regions reflecting the difference in the target luminance-voltage characteristic appear, making it impossible to display a smooth image.

According to this aspect, the position of the target pixel is located, when the pixel is located near the boundary with the other neighboring divided regions, the light-emitting efficiency and the light-emission starting current value of the pixel are calculated based on the light-emitting efficiency and the light-emission starting current value of the divided region including the pixel and the light-emitting efficiency and the light-emission starting current value of the other neighboring divided regions. Subsequently, the current-voltage characteristic of the target pixel is calculated by dividing the luminance value of the luminance-voltage characteristic for each pixel by the light-emitting efficiency of the target pixel, and by adding, to the divided value, the light-emission starting current value of the target pixel, and the correction parameter for correcting the current-voltage characteristic of the target pixel to the representative current-voltage characteristic is calculated.

With this, the light-emitting efficiency and the light-emission starting current value of the pixel located near the boundary of the other neighboring divided regions are set to be a light-emitting efficiency and a light-emission starting current value calculated based on the light-emitting efficiency and the light-emission starting current value of the divided region including the pixel and the light-emitting efficiency and the light-emission starting current value of the other neighboring divided regions, instead of the light-emitting efficiency and the light-emission starting current value of the each divided region. Thus, the variations between pixels arranged near the boundary of the divided regions can be reduced. Accordingly, it is possible to prevent the boundary of the divided regions from appearing on screen, allowing a display of a smoother image.

The method of fabricating an organic EL display apparatus according to an aspect of the present invention includes in the calculating of a current-voltage characteristic of each pixel, when calculating the light-emitting efficiency and the light-emission starting current value of the target pixel, it is possible that the closer the target pixel to the boundary with the other neighboring divided region, the higher a ratio of the light-emitting efficiency and the light-emission starting current value of the other neighboring divided region used for the weighting.

According to this aspect, when calculating the light-emitting efficiency and the light-emission starting current value of the target pixel, the weighting is performed, increasing the ratio of the light-emitting efficiency and the light-emission starting current value of the other neighboring divided regions, the closer the position of the pixel to the boundary of the other neighboring divided regions. Accordingly, smoother images can be displayed.

In the method of fabricating an organic EL display apparatus according to an aspect of the present invention, in the calculating of a current-voltage characteristic of each pixel, when calculating the light-emitting efficiency and the light-emission starting current value of the target pixel, the light-emitting efficiency and the light-emission starting current value of the target pixel may be calculated according to a ratio between a distance from the target pixel to the center of the divided region including the target pixel and a distance from the target pixel to the center of each of the other neighboring divided region.

According to this aspect, when calculating the light-emitting efficiency and the light-emission starting current value of the target pixel, the light-emitting efficiency and the light-emission starting current value of the pixel are calculated according to a ratio of the distance from the pixel to the center of the divided region to which the pixel belongs and the distance from the pixel to the center of the other neighboring divided region.

In the method of fabricating an organic EL display apparatus according to an aspect of the present invention, in the calculating of a light-emitting efficiency and a light-emission starting current value, the light-emitting efficiency and the light-emission starting current value calculated in a method of fabricating another organic EL display apparatus fabricated under a same condition may be used as the light-emitting efficiency and the light-emission starting current value of each of the divided regions.

According to this aspect, the light-emitting efficiency and the light-emission starting current value of each divided region calculated in the method of fabricating an organic EL display apparatus can be used for the method of fabricating another organic EL display apparatus fabricated under the same condition as the organic EL display apparatus. Thus, it is possible to omit the process for calculating the light-emitting efficiency and the light-emission starting current value of the divided regions for each display panel, each time the correction parameters for more than one display panel are measured. Consequently, it is possible to shorten the fabricating process of the apparatus.

In the method of fabricating an organic EL display apparatus according to an aspect of the present invention, in the obtaining of a representative current-voltage characteristic, a representative current-voltage characteristic obtained in a method of fabricating another organic EL display apparatus fabricated under a same condition may be used as the representative current-voltage characteristic.

According to this aspect, the representative current-voltage characteristic calculated in the method of fabricating one organic EL display apparatus can be used for the method of fabricating another organic EL display apparatus fabricated under the same condition as the organic EL display apparatus. Thus, it is possible to omit the process for setting the representative voltage-current characteristic each time the correction parameters for more than one display panel are measured. Consequently, it is possible to shorten the fabricating process of the apparatus.

In the method of fabricating an organic EL display apparatus according to an aspect of the present invention includes writing, on a predetermined memory used for the display panel, the correction parameter for each pixel calculated in the calculating of a correction parameter.

According to this aspect, the correction parameter for each pixel is written on a predetermined memory used for the display panel.

As described above, the current-voltage characteristic of each pixel is calculated by dividing the display panel into multiple divided regions, dividing the luminance value of the luminance-voltage characteristic of each pixel by the light-emitting efficiency indicating the characteristic common in the divided region to which the pixel belongs, and by adding, to the divided value, the light-emission starting current value of the divided region to which the pixel belongs. Thus, the amount of correction by the correction parameter of each pixel is smaller than in the case when the correction parameter is calculated using the representative voltage-luminance characteristic common to the entire display panel. Thus, the range of the values of the correction parameters for the pixels can be made smaller, and it is possible to reduce the bit count of the memory allotted to the value of the correction parameter. As a result, it is possible to reduce the capacity of the memory, lowering the fabrication cost.

In the method of fabricating an organic EL display apparatus according to an aspect of the present invention, in the obtaining of a representative current-voltage characteristic, a plurality of voltages may be applied to a plurality of pixels to be measured to flow current in the pixels to be measured, the current flowing in each of the pixels to be measured may be measured for each of the voltages, and the representative current-voltage characteristic may be calculated by averaging the current-voltage characteristics of the pixels to be measured.

According to this aspect, the representative current-voltage characteristic is calculated by applying multiple voltages to flow current in the pixels to be measured, and by averaging the current-voltage characteristics obtained for the pixels to be measured. With this, only the current flowing in the pixels to be measured is measured, instead of the current flowing in all of the pixels included in the display panel. Thus, it is possible to significantly shorten the time until the representative current-voltage characteristic common to the entire display panel is set.

The method of fabricating an organic EL display apparatus according to an aspect of the present invention includes in the obtaining of a representative current-voltage characteristic, a plurality of common voltages may be simultaneously applied to the pixels to be measured to flow current in each of the pixels to be measured, a sum of the current flowing in the pixels to be measured may be calculated for each of the common voltages, and the representative current-voltage characteristic may be calculated by dividing the sum of the current flowing in the pixels to be measured by the number of the pixels to be measured.

According to this aspect, the representative current-voltage characteristic common to the entire display panel may be calculated by applying common voltages to the pixels to be measured at one time, measuring the sum of the currents flowing in the pixels to be measured, and by dividing the sum of the measured currents by the number of the pixels to be measured.

In the method of fabricating an organic EL display apparatus according to an aspect of the present invention, a correction parameter may include a parameter indicating a ratio of a voltage of the current-voltage characteristic of the target pixel calculated in the calculating of a current-voltage characteristic to a voltage of the representative current-voltage characteristic.

According to this aspect, the correction parameter is the gain indicating the voltage gain in the representative current-voltage characteristic to the current-voltage characteristic of the target pixel calculated in the calculating.

In the method of fabricating an organic EL display apparatus according to an aspect of the present invention, a correction parameter may include a parameter indicating a ratio of a current of the current-voltage characteristic of the target pixel calculated in the calculating of a current-voltage characteristic to a current of the representative current-voltage characteristic.

According to this aspect, the correction parameter is the gain indicating the current gain in the representative current-voltage characteristic to the current-voltage characteristic of the target pixel calculated in the calculating.

In the method of fabricating an organic EL display apparatus according to an aspect of the present invention, a correction parameter may include a parameter indicating a difference between a voltage of the current-voltage characteristic of the target pixel calculated in the calculating of a current-voltage characteristic and a voltage of the representative current-voltage characteristic.

According to this aspect, the correction parameter is the offset indicating the amount of shift in the voltage of the representative current-voltage characteristic to the current-voltage characteristic of the target pixel calculated in the calculating.

Furthermore, the present invention produces the effects equivalent to the effects described above, not only as the method of fabricating the organic EL display apparatus including the characteristic steps, but also as an organic EL display apparatus having the correction parameters generated using the characteristic steps included in the method of fabricating.

Embodiment 1

In this Embodiment, a fabricating process for generating a correction parameter for correcting the unevenness in the luminance of the display panel included in the organic EL display apparatus according to the present invention, and storing the correction parameter in the organic EL display apparatus shall be described. The stored correction parameter is used in a display operation after the organic EL display apparatus is shipped.

The following fabricating process includes (1) obtaining a representative current-voltage characteristic common to an entire display panel; (2) dividing the display panel into a plurality of divided regions, applying voltage to the driving device in each of the pixels, measuring a current flowing in each of the divided regions and luminance of light emitted from the divided region when the current is flowing in the divided region, calculating a luminance-current characteristic of the divided region according to the measured current flowing in the divided region and the measured luminance of the light emitted from the divided region, and calculating a luminance-current conversion equation from the luminance-current characteristic for each of the divided regions; (3) measuring luminance of light emitted from each of the pixels by a predetermined measuring device and calculating a luminance-voltage characteristic of each of the pixels; (4) calculating a current-voltage characteristic of each pixel by the luminance-voltage characteristic calculated for the pixel and the luminance-current conversion equation for the divided region; (5) calculating a correction parameter for a target pixel such that the current-voltage characteristic of the target pixel is corrected to the representative current-voltage characteristic; and (6) writing, on a predetermined memory, the correction parameter for each pixel calculated in the calculating of a correction parameter. With this, it is possible to set a same current flowing in the light-emitting devices for the same specified gray-scale, making the current load constant between the light-emitting devices. Thus, the chronological unevenness in the light-emitting devices included in the display panel can be prevented.

The following shall describe the organic EL display apparatus and the method of fabricating the organic EL display apparatus according to the present invention shall be described with reference to the drawings.

FIG. 1 is a block diagram illustrating electric configuration of the organic EL display device 1 according to Embodiment of the present invention. The organic EL display apparatus 1 in FIG. 1 includes a control circuit 12 and a display panel 11. The control circuit 12 includes a memory 121. The display panel 11 includes a scanning line driving circuit 111, a data line driving circuit 112, and a display unit 113. Note that, the memory 121 may be provided inside the organic EL display apparatus 1 and outside of the control circuit 12.

The control circuit 12 controls the memory 121, the scanning line driving circuit 111, and the data line driving circuit 112. After the completion of the fabricating process according to the fabricating method described in Embodiment 1, correction parameters generated in the method of fabricating the organic EL display apparatus according to the present invention are stored in the memory 121. At the time of display operation, the control circuit 12 reads the correction parameters written on the memory 121, and corrects the video signal data input from outside, based on the correction parameter, and outputs the corrected image signal data to the data line driving circuit 112.

The control circuit 12 is also capable of driving the display panel 11 according to an instruction of an outside information processor by communicating with the information processor during the fabricating process.

The display unit 113 includes multiple pixels, and displays the image based on the input video signal from outside to the organic EL display apparatus 1.

Figure 2:
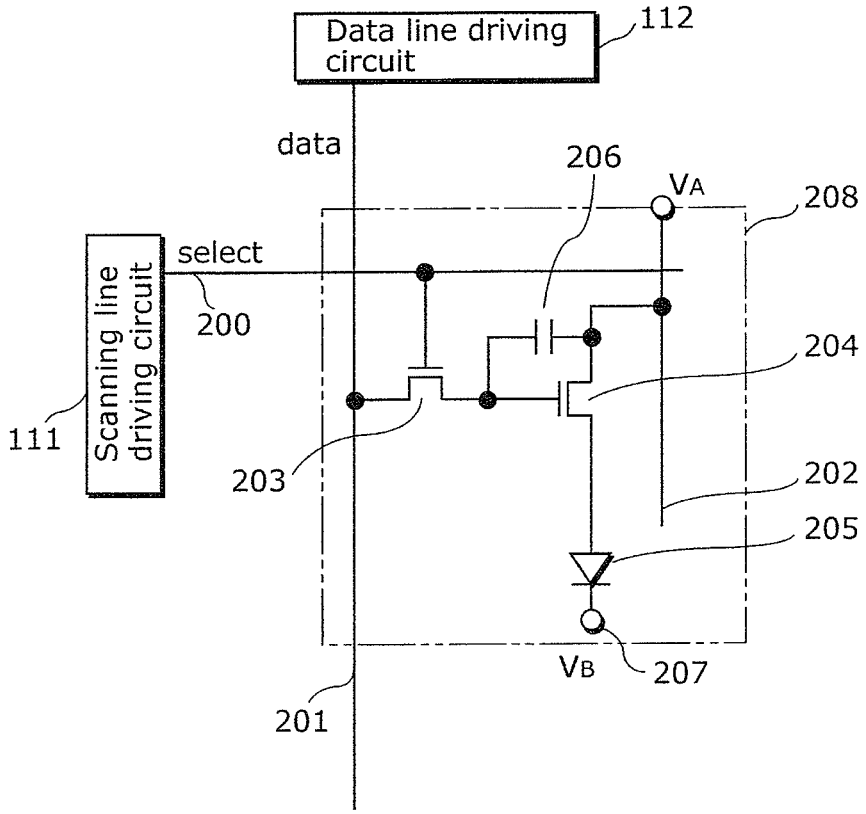
FIG. 2 illustrates an example of circuit configuration of a pixel in the display unit and a connection with circuits around the pixel.

FIG. 2 illustrates an example of circuit configuration of a pixel in the display unit and a connection with circuits around the pixel. A pixel 208 in FIG. 2 includes a scanning line 200, a data line 201, a power supply line 202, a selection transistor 203, a driving transistor 204, an organic EL device 205, a holding capacitor 206, and a common electrode 207. As the peripheral circuits, a scanning line driving circuit 111 and a data line driving circuit 112 are provided.

The scanning line driving circuit 111 is connected to the scanning line 200, and is capable of controlling conduction and non-conduction of the selection transistor 203 for the pixel 208.

The data line driving circuit 112 is connected to the data line 201, and is capable of outputting the data voltage and determining the signal current flowing in the driving transistor 204.

The selection transistor 203 has the gate connected to the scanning line 200, and is capable of controlling the timing for supplying a data voltage in the data line 201 to the gate of the driving transistor 204.

The driving transistor 204 functions as a driving device, and has the gate connected to the data line 201 via the selection transistor 203, the source connected to the anode of the organic EL device 205, and the drain connected to the power supply line 202. With this, the driving transistor 204 converts the data voltage supplied to the gate to a signal current corresponding to the data voltage, and supplies the converted signal current to the organic EL device 205.

The organic EL device 205 functions as a light-emitting device, and the cathode of the organic EL device 205 is connected to the common electrode 207.

The holding capacitor 206 is connected between the power supply line 202 and the gate terminal of the driving transistor 204. The holding capacitor 206 is capable of, for example, even when the selection transistor 203 is turned off, maintaining the gate voltage immediately before, and supplying the driving current from the driving transistor 204 to the organic EL device 205 continuously.

Note that, although not illustrated in FIGS. 1 and 2, the power supply line 202 is connected to the power supply. The common electrode 207 is also connected to another power supply.

The data voltage supplied from the data line driving circuit 112 is applied to the gate terminal of the driving transistor 204 through the selection transistor 203. The driving transistor 204 passes a current according to the data voltage between the source terminal and the drain terminal. This current flows into the organic EL device 205, and the organic EL device 205 emits light at a luminance according to the current.

Next, a fabricating system for implementing the method of fabricating the organic EL display apparatus shall be described.

Figure 3:
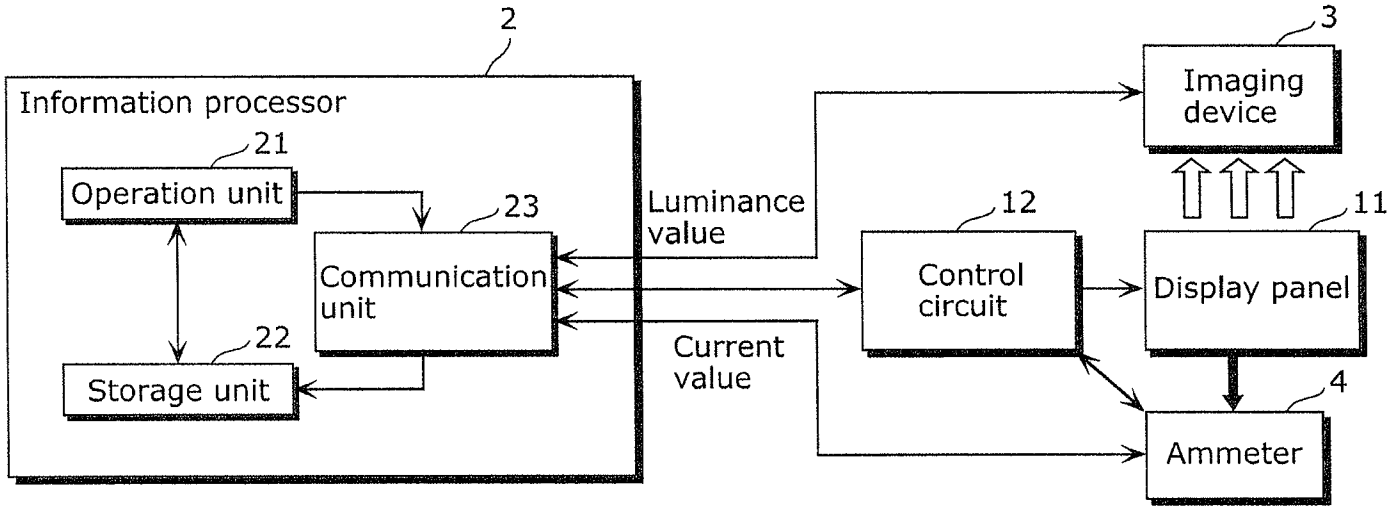
FIG. 3 is a functional block diagram of a fabricating system used for the method of fabricating the organic EL display apparatus according to the present invention.

FIG. 3 is a functional block diagram illustrating the fabricating system used for the method of fabricating the organic EL display device according to the present invention. The fabricating system in FIG. 3 includes an information processor 2, an imaging device 3, an ammeter 4, a display panel 11, and a control circuit 12.

The information processor 2 includes an operation unit 21, a storage unit 22, and a communication unit 23, and is capable of controlling the process until the correction parameter is generated.

As the information processor 2, a personal computer is applied, for example.

The imaging device 3 captures an image of the display panel 11 according to a control signal from the communication unit 23 in the information processor 2, and outputs the captured image data to the communication unit 23. A CCD camera or a luminance meter is used as the imaging device 3, for example.

The ammeter 4 measures the current flowing in the driving transistor 204 and the organic EL device 205 in each pixel, according to the control signals from the communication unit 23 in the information processor 2 and from the control circuit 12, and outputs the measured current value data to the communication unit 23.

The information processor 2 outputs the control signals to the control circuit 12, the imaging device 3, and the ammeter 4 in the organic EL display device 1 through the communication unit 23, obtains the measured data from the control circuit 12, the imaging device 3, and the ammeter 4, stores the measured data in the storage unit 22, and performs operations in the operation unit 21 based on the stored measured data to calculate the characteristic values and parameters. Note that, a control circuit not incorporated in the organic EL display apparatus 1 may be used as the control circuit 12.

More specifically, when setting representative current-voltage characteristics (hereafter referred to as representative I-V characteristics) which shall be described later, the information processor 2 controls a voltage value to the measured pixel and the ammeter 4 which measures the current flowing in the measured pixel, and receives the measured current value. Note that, here, the imaging device 3 may not be provided. Furthermore, when measuring the luminance-current characteristics (hereafter referred to as L-I characteristics) of the organic EL device which shall be described later, the information processor 2 controls a voltage value to the measured pixel, controls the imaging device 3, and controls the ammeter 4, and receives the measured luminance value and the measured current value. Furthermore, when measuring the luminance-voltage characteristics (hereafter referred to as L-V characteristics) of each pixel, the information processor 2 controls a voltage value to the measured pixel, controls the imaging device 3, and receives the measured luminance value.

The control circuit 12 controls a voltage value to the pixel 208 in the display panel 11 by the control signal from the information processor 2. Furthermore, the control circuit 12 is capable of writing the correction parameter generated by the information processor 2 to the memory 121.

Next, the method of fabricating the organic EL display apparatus according to the present invention shall be described.

Figure 4:
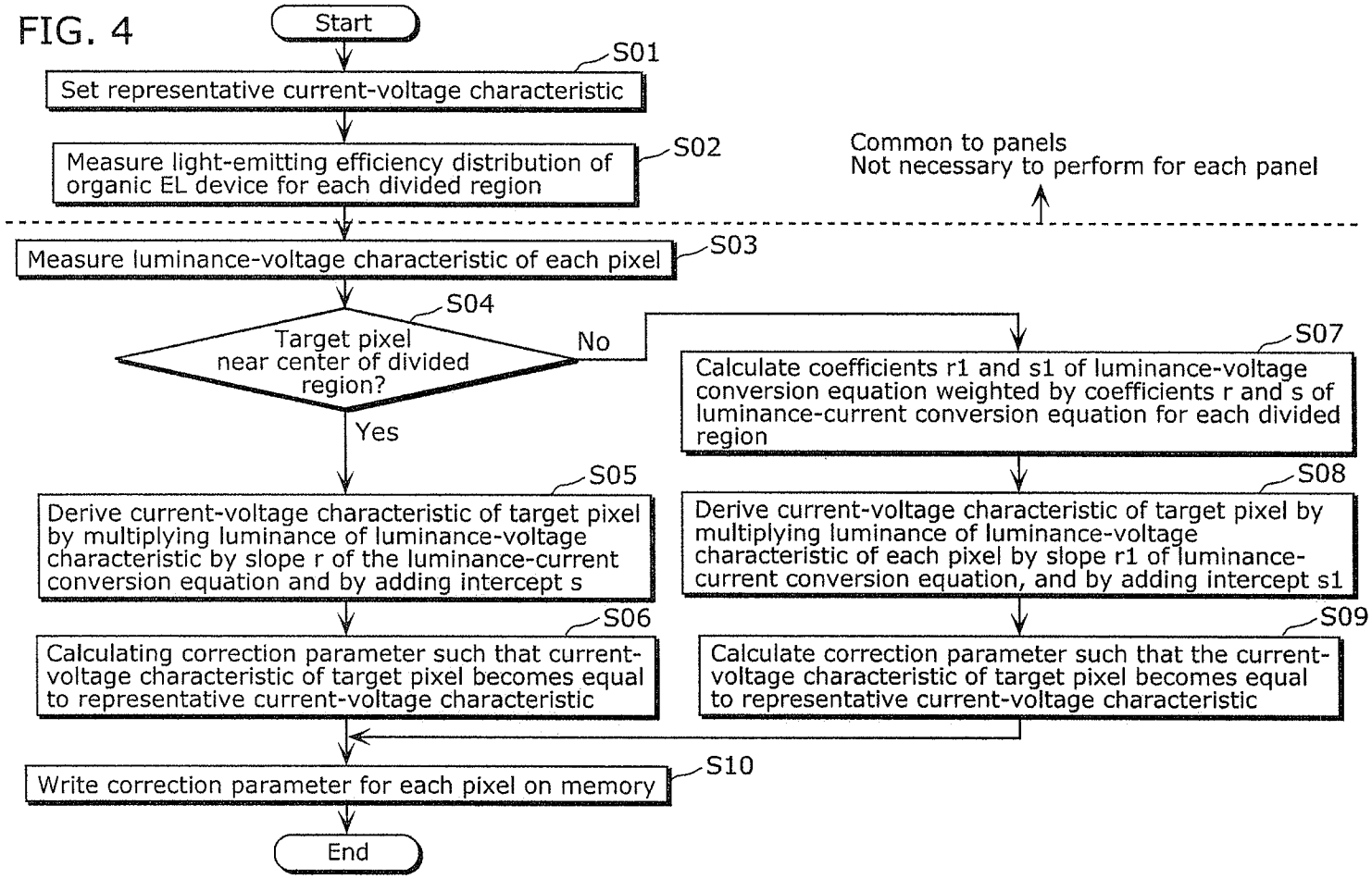
FIG. 4 is an operational flowchart illustrating the method of fabricating the organic EL display apparatus according to Embodiment 1 of the present invention.
Figure 5A:
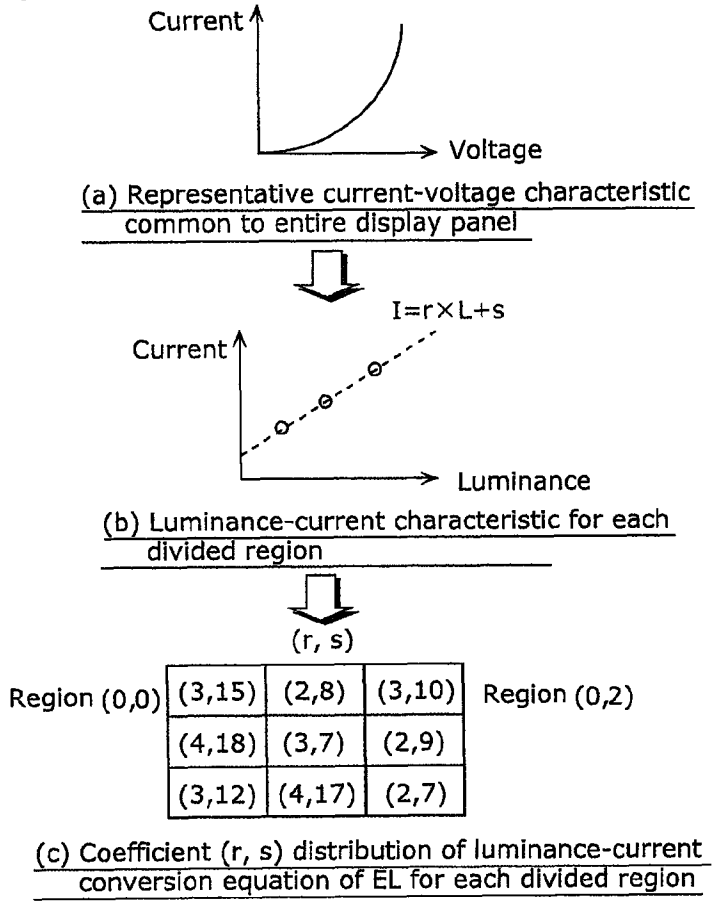
FIG. 5A illustrates charts for illustrating characteristics obtained by the first process group in the method of fabricating the organic EL display device according to Embodiment 1 of the present invention.
Figure 5B:
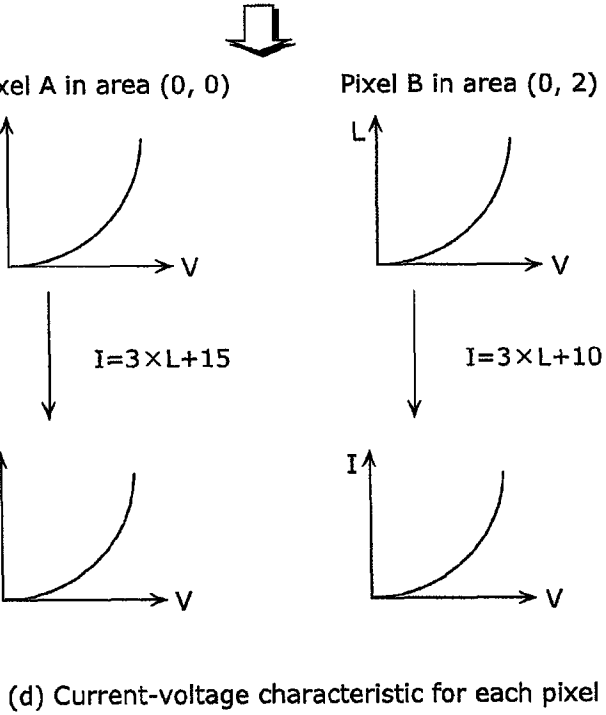
FIG. 5B illustrates charts for illustrating characteristics obtained by the second process group in the method of fabricating the organic EL display device according to Embodiment 1 of the present invention.

FIG. 4 is an operational flowchart illustrating a method of fabricating an organic EL display apparatus according to Embodiment 1 of the present invention. FIG. 5A illustrates charts for illustrating characteristics obtained by the first process group in the method of fabricating the organic EL display device according to Embodiment 1 of the present invention. FIG. 5B illustrates charts for illustrating characteristics obtained by the second process group in the method of fabricating the organic EL display device according to Embodiment 1 of the present invention.

FIG. 6 illustrates charts for illustrating characteristics obtained by the third process group in the method of fabricating the organic EL display device according to Embodiment 1 of the present invention.

FIG. 4 illustrates process from generating an effective correction parameter for correcting variations in luminance in the display panel included in the organic EL display apparatus 1 to store the correction parameter in the organic EL display apparatus 1. The effective correction parameter is for mainly correcting the variations in the driving transistors 204 so as to suppress chronological degradation of the organic EL device 205. However, the correction parameter is generated without measuring current in each pixel 208.

In order to generate the correction parameter, in this fabricating method, the display unit 113 is divided into divided regions having multiple pixels 208, and the L-I characteristics for each divided region is determined. Note that, the divided regions are divided based on slight luminance inclination on the display panel 11 caused by the fabrication process of the organic EL device 205. Finally, by comparing the I-V characteristics for each pixel derived from the L-I characteristics of each divided region and the representative I-V characteristics, the correction parameter due to the variation mainly in the driving transistor 204 is generated.

The following shall describe the fabricating process with reference to FIG. 4.

First, the information processor 2 obtains and sets the representative I-V characteristics common to the entire display unit 113 including multiple pixels each having the organic EL device 205 which is a light-emitting device and the driving transistor 204 which is a driving device which is voltage-driven and for controlling the supply of a current to the organic EL device 205 (S01). In (a) in FIG. 5A, the representative I-V characteristics common to the entire display unit 113 is illustrated. The representative I-V characteristics is the characteristics of the drain current corresponding to the voltage applied to the gate of the driving transistor 204, and is nonlinear.

Figure 7B:
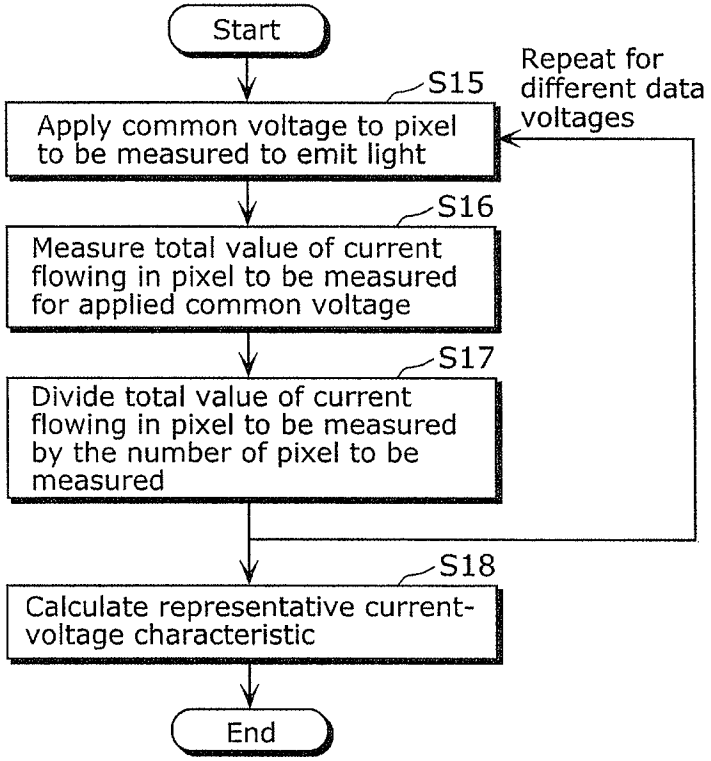
FIG. 7B is an operational flowchart illustrating the second specific method for obtaining the representative I-V characteristics.
Figure 7A:
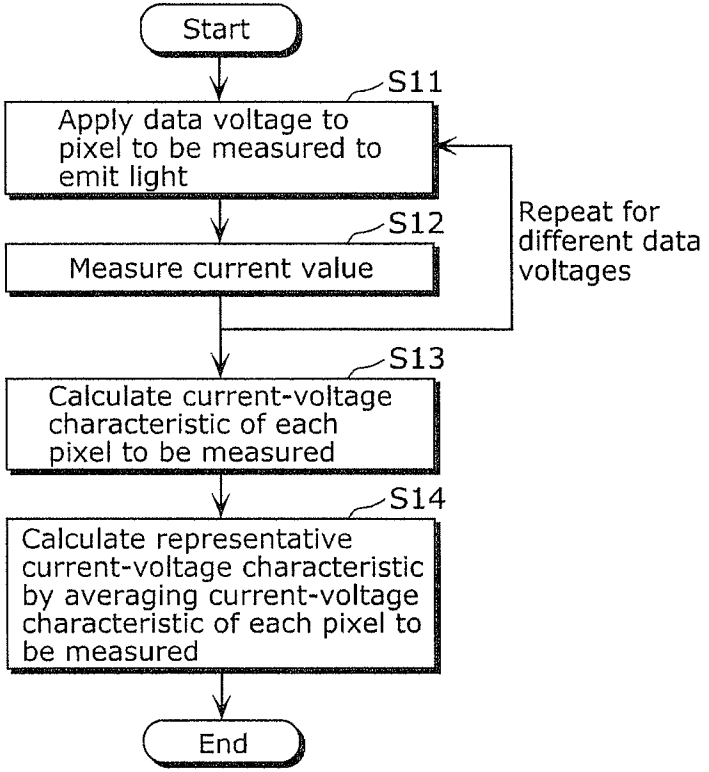
FIG. 7A is an operational flowchart illustrating the first specific method for obtaining the representative I-V characteristics.

FIG. 7A is an operational flowchart illustrating the first specific method for obtaining the representative I-V characteristics. In this method, a pixel to be measured for determining the representative I-V characteristics is extracted from the multiple pixels included in the display unit 113. This pixel to be measured may be one pixel, or may be more than one pixels selected based on a regularity or randomly selected.

First, the information processor 2 has the control circuit 12 to apply a data voltage to the pixel to be measured such that a current flows in the pixel, causing the organic EL device 205 in the pixel to emit light (S11).

Next, the information processor 2 has the ammeter 4 to measure the current in step S11 (S12). Steps 11 and 12 are repeated for more than once for different data voltages. Steps 11 and 12 may be performed at the same time for multiple pixels to be measured. Alternatively, steps 11 and 12 may be repeatedly performed for each pixel to be measured.

Next, the information processor 2 calculates the I-V characteristics for each pixel to be measured by the operation unit 21, based on the data voltage and the current corresponding to the data voltage obtained in steps S11 and S12 (S13).

Next, the information processor 2 calculates the representative I-V characteristics by averaging the I-V characteristics obtained for each of the pixels to be measured (S14).

FIG. 7B is an operational flowchart illustrating the second specific method for obtaining the representative I-V characteristics. In this method, a pixel to be measured for determining the representative I-V characteristics is extracted from the multiple pixels included in the display unit 113. This pixel to be measured may be one pixel, or may be more than one pixels selected based on a regularity or randomly selected.

First, the information processor 2 has the control circuit 12 to apply a common data voltage to the pixels to be measured such that a current flows in the pixels at the same time, causing the organic EL devices 205 in the pixels to emit light at the same time (S15).

Next, the information processor 2 has the ammeter 4 to measure the sum of currents flowing in the pixels to be measured in step S15 (S16). Steps 15 and 16 are repeated for more than once for different data voltages.

Next, the information processor 2 causes the operation unit 21 to divide the sum of the current values calculated in Steps 15 and 16 by the number of pixels to be measured (S17).

Next, the representative I-V characteristic is calculated by performing step S17 for each data voltage (S18).

Calculating the representative I-V characteristics by the method described in FIGS. 7A and 7B allows measuring the current only for the pixels to be measured, instead of measuring the currents flowing in all of the pixels included in the display unit 113. Thus, it is possible to dramatically shorten the time necessary for setting the representative I-V characteristics common to the entire display unit 113.

Note that, the first and second specific methods for obtaining the representative I-V characteristics may not be performed for each organic EL display apparatus according to the present invention. For example, the representative I-V characteristics obtained in a method of fabricating another organic EL display apparatus fabricated in the same condition may be used as the representative I-V characteristics of the organic EL display apparatus without modification.

Accordingly, the representative I-V characteristics calculated in the method of fabricating an organic EL display apparatus is used in the method of fabricating another organic EL display apparatus fabricated in the same condition as the organic EL display apparatus. Therefore, it is possible to omit extra process necessary for setting the representative I-V characteristics each time the correction parameter of the display panels is measured. Consequently, it is possible to shorten the fabricating process of the apparatus.

The following shall describe the fabricating process with reference to FIG. 4 again.

Next, the information processor 2 divides the display panel into multiple divided regions, and has the driving transistor 204 included in each pixel to apply voltage, and measures the current flowing in the divided region and the luminance of emitted light in the divided region at that time. As such, the L-I characteristics of each divided region is calculated, and an L-I conversion equation for each divided region is obtained based on the L-I characteristics (S02). By the execution of step S02, the L-I characteristics of each divided region illustrated in FIG. 5A (b) is obtained. The L-I characteristics is approximated by the following linear function represented using a slope r defined as a reciprocal of the light-emitting efficiency, and a light-emission starting current value s which is an intercept of the current axis of the L-I characteristics;

$$I=r*L+s \quad \text{(Equation 1)}$$

The matrix illustrated in FIG. 5A (c) is coefficients (r, s) for the L-I conversion equation for each divided region calculated by approximating the L-I characteristics of each divided region by Equation 1.

Figure 8A:
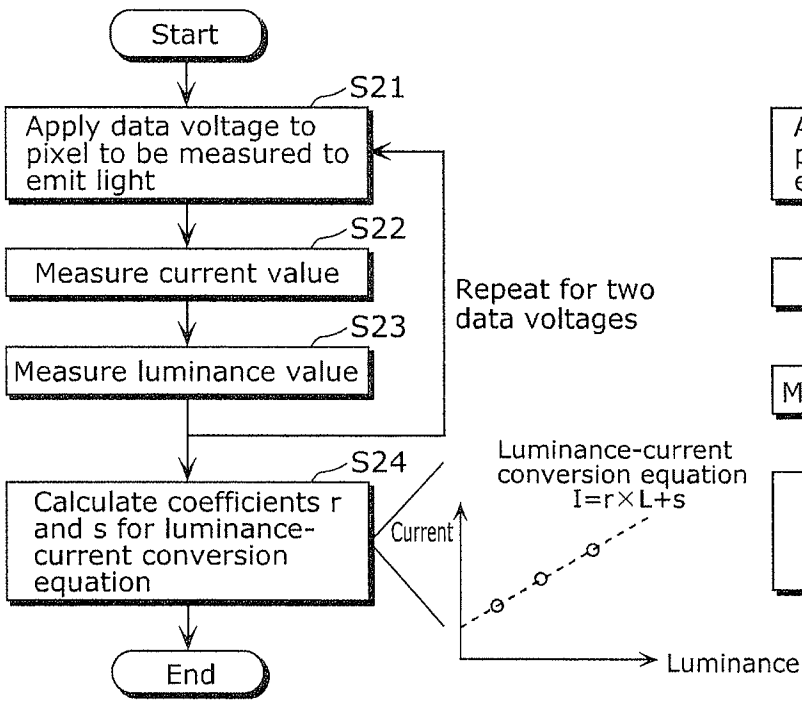
FIG. 8A is an operational flowchart illustrating the first specific method for calculating coefficients for an L-I conversion equation for each divided region.

FIG. 8A is an operational flowchart for illustrating the first specific method of calculating coefficients for the L-I conversion equation for each divided region. In this method, the pixel to be measured for determining the L-I characteristics of the divided region is extracted from the pixels included in the divided region. This pixel to be measured may be one pixel, or may be more than one pixels selected based on a regularity or randomly selected. Alternatively, the pixels to be measured may be all of the pixels included in the divided region.

First, the information processor 2 has the control circuit 12 to apply a data voltage simultaneously to the pixels to be measured such that a current flows in the pixel, causing the organic EL device 205 in the pixel to emit light (S21).

Next, the information processor 2 has the ammeter 4 to measure the current in step S21 (S22). Here, when the pixels to be measured are all of the pixels in the divided region or the multiple selected pixels, the sum of the current values is measured. Steps S21 and S22 are repeated for more than once for different data voltages.

Next, the information processor 2 have the imaging device 3 to capture the light emitted in step S21 (S23). Steps S21 to S23 are repeated for more than once for different data voltages.

Next, the information processor 2 have the operation unit 21 calculate the L-I characteristics for each divided region, based on the luminance obtained in steps S22 and S23 and luminance corresponding to the current, and calculate the coefficients (r, s) of the L-I conversion equation described above (S24). Note that, when the pixels to be measured included in the divided region is the all of the pixels in the divided region or the selected multiple pixels, the L-I characteristics for each divided region is calculated using an average current value I obtained by dividing the sum of the current values by the number of pixels to be measured.

Figure 8B:
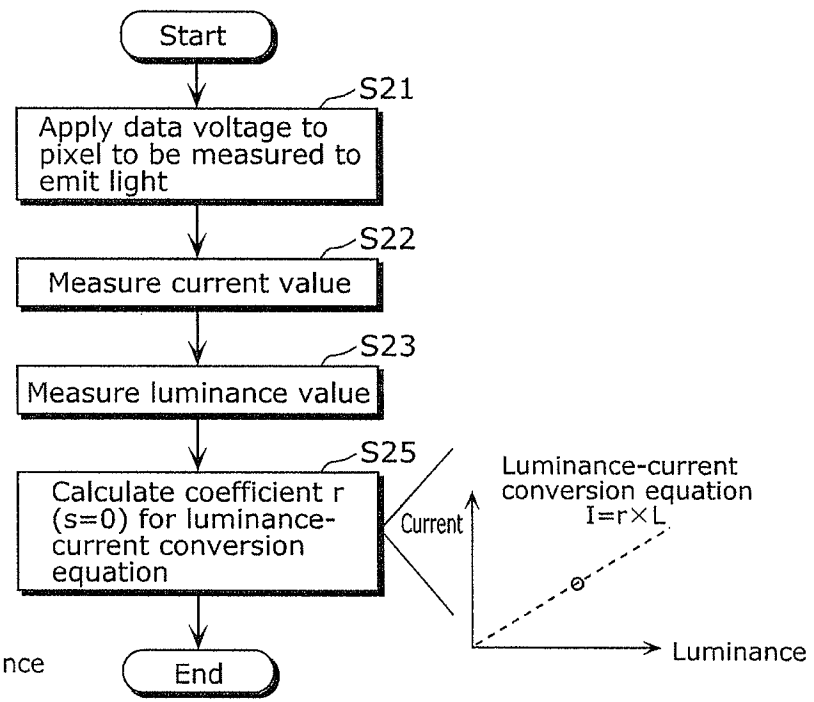
FIG. 8B is an operational flowchart illustrating the second specific method for calculating coefficients for an L-I conversion equation for each divided region.

FIG. 8B is an operational flowchart for illustrating the second specific method of calculating coefficients for the L-I conversion equation for each divided region. The method described in FIG. 8B is different from the method in FIG. 8A in that the steps S21 to S23 are performed only once. This method is applied when the L-I characteristics is a linear expression passing the origin, that is, when it is assumed that the light-emission starting current s is 0. In this method, the pixel to be measured for determining the L-I characteristics of the divided region is also extracted from the pixels included in the divided region. This pixel to be measured may be one pixel, or may be more than one pixels selected based on a regularity or randomly selected. Alternatively, the pixels to be measured may be all of the pixels included in the divided region.

Note that, the first and second specific methods for obtaining the coefficients for L-I conversion equation of each divided region may not be performed for each organic EL display apparatus according to the present invention. For example, as the coefficients, the coefficients of the L-I conversion equation for each divided region obtained in the method of fabricating another organic EL display apparatuses fabricated in the same condition may be used as the coefficients for the organic EL display device without modification. With this, the light-emitting efficiency and the light-emission starting current value of each divided region obtained in the method of fabricating an organic EL display apparatus are used for the method of fabricating the other organic EL display apparatus fabricated under the same condition as the organic EL display apparatus. Thus, it is possible to omit the extra process for calculating the light-emitting efficiency and the light-emission starting current value for each display panel each time the correction parameter for display panels are measured can be omitted. Consequently, it is possible to shorten the fabricating process of the apparatus.

The following shall describe the fabricating process with reference to FIG. 4 again.

Next, the information processor 2 have the imaging device 3 measures the luminance of the light emitted from each pixel included in the display unit 113, and calculates the L-V characteristics of each pixel (S03). Here, if the L-V characteristics of each pixel is measured by applying voltage to each pixel and measure the luminance, it is necessary to measure the luminance for the number of times as much as the number of the pixels, increasing the time for measurement and fabricating cost. In this Embodiment, the L-V characteristics of each pixel can be determined by a measurement for all of the pixels at once, without performing the measurement for the number of times as much as the number of the pixels.

Figure 9B:
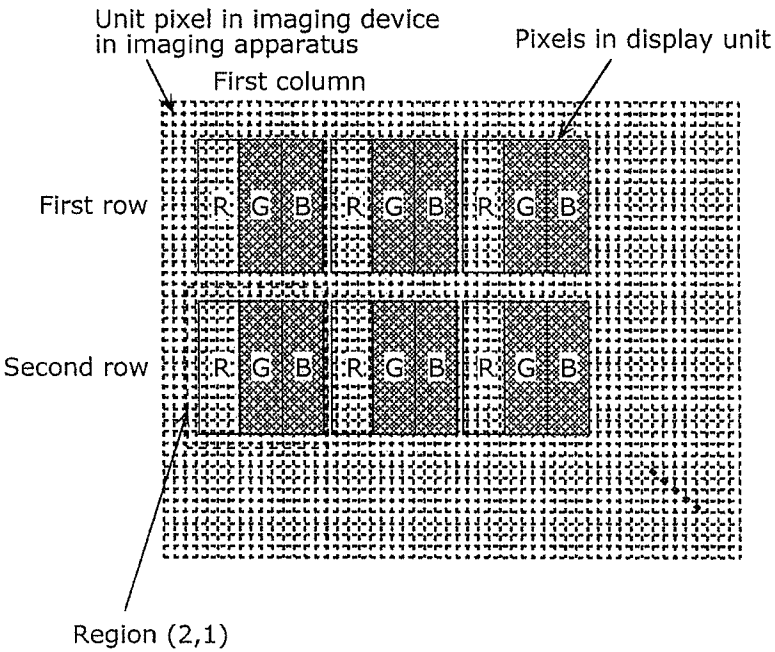
FIG. 9B is a diagram for illustrating a captured image when calculating the L-V characteristics of each pixel.
Figure 9A:
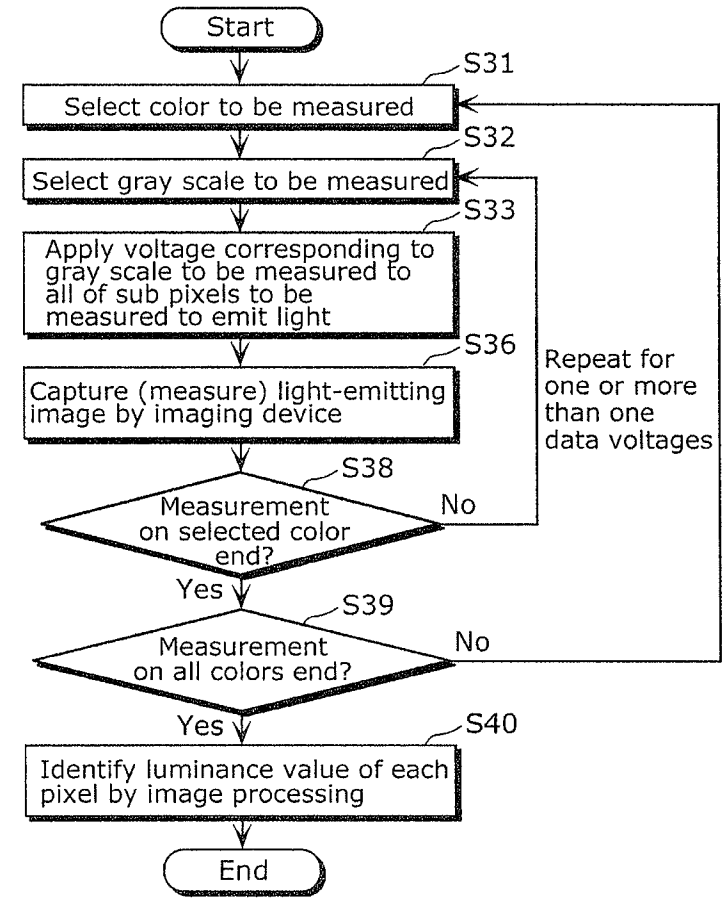
FIG. 9A is an operational flowchart illustrating the first specific method for obtaining the L-V characteristics of each pixel.

FIG. 9A is an operational flowchart for describing a first specific method for calculating the L-V characteristics for each pixel. FIG. 9B illustrates the captured image when calculating the L-V characteristics in each pixel.

First, the information processor 2 selects the color to be measured (S31). In this embodiment, suppose that the display unit 113 includes pixels 208 each having red (R), green (G), and blue (B) sub pixels.

Next, the information processor 2 selects the gray-scale to be measured (S32).

Next, the information processor 2 applies the voltages according to the selected gray-scales to all of the sub pixels in the selected color, causing all of the sub pixels to emit light simultaneously (S33).

Next, the information processor 2 have the imaging device 3 capture the light emitted from the entire sub pixels at the same time (S36). FIG. 9B illustrates an image captured by the imaging device 3 showing the light-emitting state of the display unit 113 in a gray-scale, when red is selected. The grid pattern on the entire diagram indicates unit pixels in the light-receiving unit of the imaging device 3. Since the unit pixel in the light-receiving unit of the imaging device 3 is sufficiently small with respect to the captured sub pixels in R, the luminance of each of the R sub pixel can be determined based on this image.

Next, the information processor 2 changes the gray-scale to be measured (No in S38), and performs steps S33 and S36.

Furthermore, when steps S33 and S36 end in all of the gray-scales to be measured (Yes in S38), the color to be measured is changed (No in S39), and steps S32 to 538 are executed.

Furthermore, when steps S32 to 538 end for all of the colors (Yes in S39), the information processor 2 obtains the images obtained in steps S31 to S39, and determines the luminance of each pixel based on the obtained image (S40). In this step, the luminance value of the pixel in the region (2, 1) is calculated as an average value of output values of the pixels in the imaging device belonging to the region (2, 1), for example.

According to this method, when obtaining the L-V characteristics of each pixel, the simultaneous light-emission of all of the sub pixels in the light-emitting panel is captured at one time, without capturing light emitted from each pixel by applying the predetermined voltage. Subsequently, based on the captured image, the luminance of the light emitted from each sub pixel is determined by image processing separating the light emitted from each pixel. Accordingly, it is possible to significantly reduce the time for capturing image, considerably simplifying the process for obtaining the L-V characteristics for each pixel.

FIG. 10A is an operational flowchart for illustrating the second specific method of calculating coefficients for the L-V characteristics for each pixel. FIG. 10B is a diagram for illustrating a captured image when calculating the L-V characteristics for each pixel. Furthermore, FIG. 10C is a state transition diagram of the measured pixels that are selected. The method illustrated in FIG. 10A is different from the method illustrated in FIG. 9A in that steps S34 and S37 are added. More specifically, the method illustrated in FIG. 10A does not obtain the captured image by simultaneously causing all of the corresponding sub pixels to emit light in the selected color or selected gray-scale. Instead, multiple captured images are obtained by causing the sub pixels to emit light separately for multiple times. According to this method, it is possible to avoid the interference of the light emitted from the adjacent pixels, and to calculate highly precise luminance value of each pixel.

Note that, the imaging device 3 used for calculating the L-V characteristics for each pixel in FIGS. 9A and 10A is preferably an image sensor, and is more preferably a CCD camera. With this, the image of emitted light from all of the pixels can be obtained with low noise, high sensitivity, and high resolution, allowing obtaining the highly precise L-V characteristics for each pixel by image processing separating the light emitted from each pixel.

The following shall describe the fabricating process with reference to FIG. 4 again.

Next, when a pixel for which a correction parameter should be generated is not present at a boundary with other neighboring divided regions to which the pixel does not belong (Yes in step SO4), the information processor 2 calculates the I-V characteristics for each pixel based on the L-V characteristics for each pixel set in step S03 and the L-I conversion equation for the divided region to which the target pixel belongs calculated in step S02. More specifically, using the L-I characteristics of the divided region, L of the L-V characteristics for each pixel is converted to I by parameter conversion, obtaining the I-V characteristics of each pixel.

The parameter conversion shall be specifically described using (d) in FIG. 5B. For example, in the divided region matrix of coefficients (r, s) in (c) in FIG. 5A, the I-V characteristics of the pixel A belonging to the upper left divided region (0, 0) (coefficients (3, 15)) is calculated as follows. First, the luminance L of the L-V characteristics of the pixel A obtained by step S03 is multiplied by the slope r (in other words, divided by the light-emitting efficiency). Subsequently, the light-emission starting current value s is added to the multiplied value. With this, the parameter L in the L-V characteristics of the pixel A is converted to I reflecting the L-I characteristics of each divided region by parameter conversion. The I-V characteristic of each pixel is calculated by performing the conversion process for the pixel A described above (SO5).

Subsequently, the information processor 2 has the operation unit 21 calculate the correction parameter for correcting the I-V characteristics of each pixel calculated in step S05 to the representative I-V characteristics calculated in step S01, for each pixel (S06).

On the other hand, when the pixel for which the correction parameter should be generated is near the boundary with another neighboring divided region to which the pixel does not belong (No in step SO4), the information processor 2 calculates the I-V characteristics of the target pixel from the L-I conversion equation of the divided region to which the target pixel belongs to that are calculated in step S02, and L-V characteristics of each pixel calculated in step S03. The parameter conversion shall be specifically described with reference to FIG. 11.

Figure 11:
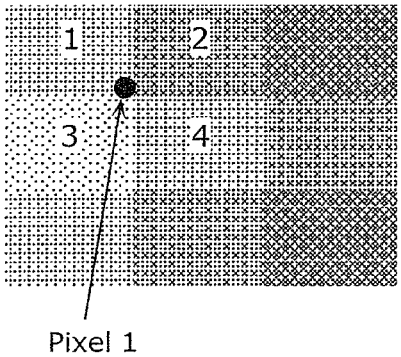
FIG. 11 is a diagram for illustrating a method of weighting coefficients of pixels at the boundary of the divided regions.

FIG. 11 is a diagram for illustrating a method of weighting coefficients of pixels at the boundary of the divided regions. As illustrated in FIG. 11, when the pixel 1 exists at the boundary region of the divided regions 1 to 4, if the correction parameter is generated using steps S05 and S06, the difference in luminance around the boundary of the divided regions may be noticeable in the corrected image. In this method, upon generating the correction parameter for pixel 1, the I-V characteristics of the pixel 1 is converted using the coefficients of the L-I conversion equation weighted by the slope r and the light-emission starting current value s between the adjacent divided regions, instead of using the coefficients (r, s) of the L-I conversion equation of the divided region 1 to which the pixel 1 belongs. Here, I-V characteristics of the pixel 1 is calculated using the coefficients (r1, s1) of the weighted L-I conversion equation (S07 and S08). In FIG. 11, the coefficient r1 of the L-I conversion equation weighted using the coefficients (r, s) of the adjacent divided regions 1 to 4 is as follows, for example.

$$r1=\{(10+8)/2+(14+2)/2\}/2=8.5 \quad \text{(Equation 2)}$$

Furthermore, the coefficient q1 of the weighted L-I conversion equation is $$s1=\{(2+5)/2+(3+4)/2\}/2=3.5 \quad \text{(Equation 3)}$$

Next, the information processor 2 calculates the I-V characteristics of the pixel 1 from the coefficients (r1, s1) of the L-I conversion equations weighted in step S07, and L-V characteristics of the pixel 1 obtained in step S3. More specifically, L in the L-V characteristics of the pixel 1 is converted to I by parameter conversion using the weighted L-I characteristics to obtain the I-V characteristics of the pixel 1. In this case, in the divided region matrix of the coefficients (r1, s1), L in the L-V characteristics for the pixel 1 obtained in step S03 by multiplying the slope r1. Subsequently, the light-emission starting current value s1 is added to the multiplied value. With this, the parameter L of the L-V characteristics for the pixel 1 is converted to I by parameter conversion. With the processes described above, the I-V characteristic of each pixel is calculated (508).

Subsequently, the information processor 2 has the operation unit 21 to calculate the correction parameter for correcting the I-V characteristics of each pixel calculated in step S08 to the representative I-V characteristics calculated in step S01, for each pixel (S09). By steps S07 to S09, the variations between the pixels arranged near the boundary of the divided regions can be reduced. Accordingly, it is possible to prevent the boundary of the divided regions from appearing on screen, allowing a display of a smoother image.

Note that, when calculating the slope r1 and the light-emission starting current value s1 of the pixel to be corrected in step S07, it is preferable that the weighting is performed increasing a ratio of the light-emitting efficiency and the light-emission starting current value of the other neighboring divided regions nearby, as the pixel is closer to the boundary with the other neighboring divided regions.

Furthermore, in step S07, when calculating the slope r1 and the light-emission starting current value s1 of the pixel to be corrected, the light-emitting efficiency and the light emission starting current value of the pixel may be calculated according to a ratio of a distance from the pixel to the center of the divided region to which the pixel belongs and the distance from the pixel to the center of the other neighboring divided region nearby. The weighting enables a display of a smoother image.

Here, the correction parameter calculated in steps S06 and S09 shall be described.

Figure 12A:
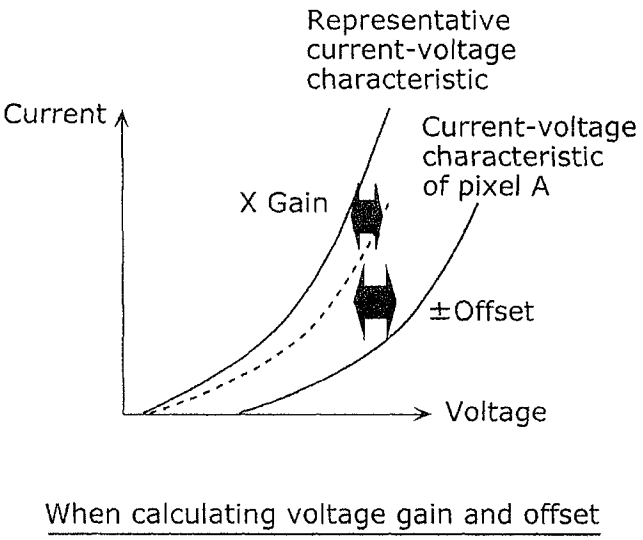
FIG. 12A is a graph illustrating the current-voltage characteristics when calculating the correction values of the voltage gain and the voltage offset in the method of fabricating the organic EL display apparatus according to Embodiment 1 of the present invention.

FIG. 12A is a graph illustrating the current-voltage characteristics when calculating the correction values of the voltage gain and the voltage offset in the method of fabricating the organic EL display apparatus according to Embodiment 1 of the present invention.

In FIG. 12A, the correction parameter includes the voltage gain including a ratio of the voltage value of the I-V characteristics of the pixel to be corrected calculated in steps S05 or S08 to the voltage value of the representative I-V characteristics set in step S01. Furthermore, the correction parameters illustrated in FIG. 12A includes the voltage offset indicating the difference between the voltage value of the I-V characteristics of the pixel to be corrected calculated in step S05 or S08, and the voltage value of the representative I-V characteristics set in step S01.

Figure 12B:
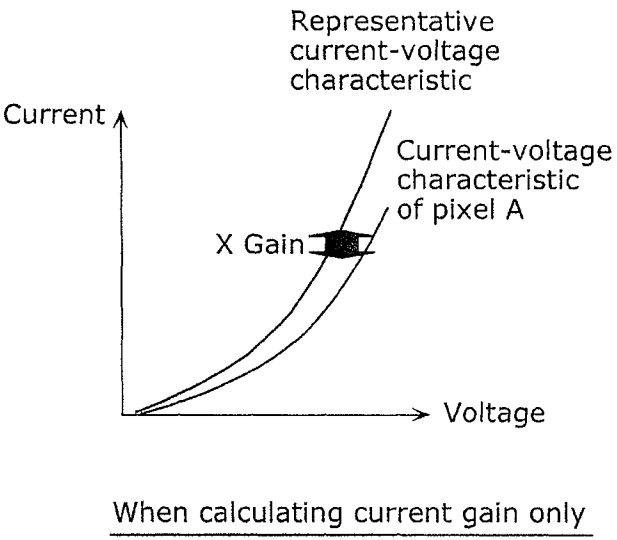
FIG. 12B is a graph illustrating current-voltage characteristics when calculating a correction value of the current gain in the method of fabricating the organic EL display apparatus according to Embodiment 1 of the present invention.

FIG. 12B is a graph illustrating the current-voltage characteristics for calculating the correction value of the current gain in the method of fabricating the organic EL display apparatus according to Embodiment 1 of the present invention. In FIG. 12B, the correction parameter includes a current gain indicating a ratio of a current value of the I-V characteristics of the pixels to be corrected that is calculated in step S05 or S08, and a current value of the representative I-V characteristics set in step 501.

Note that, the correction parameter described above is not limited to the combination in FIGS. 12A and 12B, and may be a configuration including at least one of the voltage gain, the voltage offset, and the current gain.

The following shall describe the fabricating process with reference to FIG. 4 again.

Finally, the information processor 2 writes the correction parameter for each pixel calculated in steps S06 and S09 to the memory 121 in the organic EL display apparatus 1 (S10). More specifically, as illustrated in (f) in FIG. 6, the correction parameters including (the voltage gain and the voltage offset) for each pixel are stored corresponding to the matrix of the display unit 113 (M rows×N columns), for example.

In the method of fabricating the organic EL display apparatus according the present invention, the I-V characteristics of each pixel is calculated by dividing the luminance value of the measured L-V characteristics for each pixel by the light-emitting efficiency indicating the characteristics common in each divided region, and by adding the light-emission staring current to the divided value. Accordingly, compared to the case in which the correction parameter for correcting the L-V characteristics of each pixel to the representative L-V characteristics common to the display panel, the amount of correction by the correction parameter for each pixel may be smaller. This is because, while the L-V characteristics of each pixel includes both of the variations in the driving transistor and the organic EL device, the I-V characteristics of each pixel calculated by the method described above mainly includes the variations in the driving transistors only. The range of the values of the correction parameters for the pixels can be made smaller, and it is possible to decrease the bit count of the memory allotted to the value of the correction parameter. As a result, it is possible to reduce the capacity of the memory 121, lowering the fabricating cost.

According to the conventional method of generating the correction parameters, the luminance-voltage characteristics of each pixel calculated by measuring the luminance of the light emitted from the pixel included in the display panel reflects both the variations in the organic EL device and the variations in the driving transistor. When a correction parameter for correcting both of the variations is calculated and the image signal from outside is corrected using the correction parameter, the correction includes the corrections to the variations in the organic EL device. Accordingly, this correction makes the luminance of the light emitted from the organic EL device uniform with respect to the image signal having the same gray-scale for the entire display panel.

However, due to the variations in the characteristics of the organic EL device, the luminance when the same current flows is different between the organic EL devices. Accordingly, the amount of current flowing in each pixel is different. Accordingly, in this case, due to the fact that the product life of the organic EL device depends on the amount of current, the product life of each light-emitting device varies as the time passes. The variation in product life consequently appears as uneven luminance on screen.

In response to this problem, in this Embodiment, only the variation in driving transistor is corrected, maintaining the amount of current flowing into the organic EL devices for the image signal of the same gray-scale at the same value. This is because, although the variations in the driving transistors between the devices are large, the variations in the organic EL devices between the devices are very small, and thus correcting only the variations in the driving transistors enables displaying of a uniform image to human eye without correcting variations in the organic EL devices.

According to this Embodiment, the L-I characteristics of the divided region including the pixels to be corrected is the characteristics including the variations in the organic EL devices. Accordingly, converting the L-V characteristics of the pixel to be corrected to the I-V characteristics of each pixel using the L-I characteristics of the divided region including the pixels to be corrected means calculating the correction parameter for mainly correcting the variations in the driving transistor.

Figure 13:
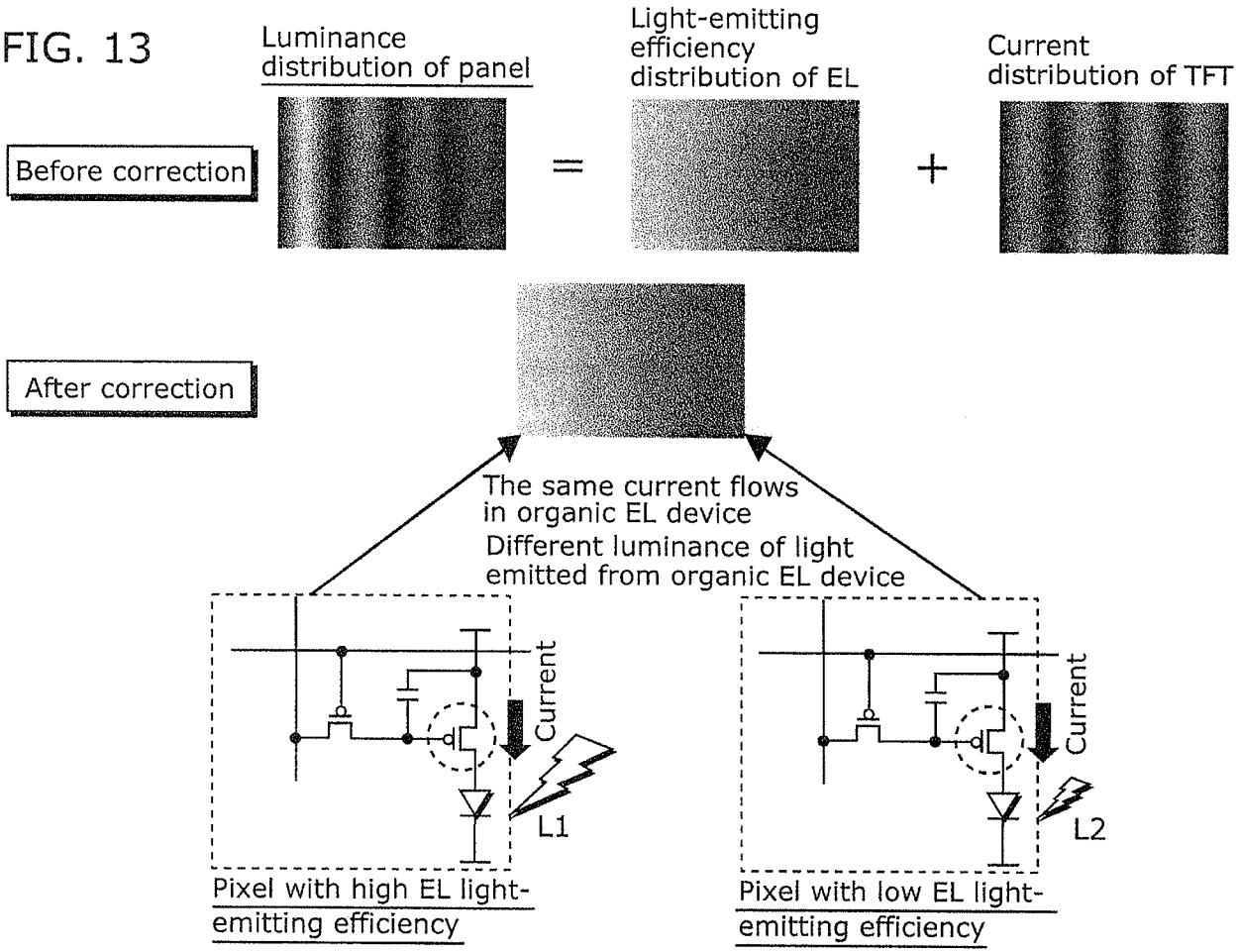
FIG. 13 illustrates the effect of the organic EL display apparatus corrected by the method of fabricating the organic EL display apparatus according to the present invention.

FIG. 13 illustrates the effect of the organic EL display apparatus corrected by the method of fabricating the organic EL display apparatus according to the present invention. The display panel in the organic EL display apparatus before correction has a luminance distribution reflecting both the luminance distribution due to the organic EL device and the luminance distribution due to the driving transistor. In contrast, according to the method of fabricating the organic EL display apparatus according to the present invention, the variations in the driving transistors are mainly corrected. Accordingly, in the display panel after the correction, although the luminance inclination due to variations in the organic EL devices remains, it is possible to maintain the current flowing into each organic EL device constant with respect to the specified same gray scale, setting the current load between the organic EL devices constant. Accordingly, it is possible to set the current flowing into each organic EL device constant, suppressing the variation in the product life of each light-emitting device included in the display panel as time passes. As a result, it is possible to prevent the uneven luminance due to the variations in the product life of the light-emitting device from appearing on screen. Note that, the luminance inclination due to the variation in the organic EL device remains in the display panel after the correction is the luminance inclination which cannot be detected by human vision.

Furthermore, according to this Embodiment, the L-V characteristics including both the variations in the organic EL devices and the variations in the driving transistors in each pixel and the light-emitting efficiency and the light-emission starting current value of each of the divided regions are measured in order to obtain the correction parameter for correcting the variations in the driving transistors, instead of measuring the variations of the driving transistors themselves. In other words, the light-emitting efficiency and the light-emission starting current value of each divided region is calculated by dividing the display panel into multiple divided regions, and measuring the current flowing in the divided region and the luminance of the divided region when the current is flowing in the divided region. In other words, by calculating the light-emitting efficiency and the light-emission starting current value of each divided region, it is possible to clarify the variations in the light-emitting devices between the divided regions. This is because; the organic EL device varies for a predetermined region, rather than for each pixel. Furthermore, the L-V characteristic of each pixel allows measuring the pixels at the same time using a CCD camera, for example. With this, compared to the case in which the variations in the driving transistor is measured by applying voltage to each pixel, and measuring the variation in the driving transistor by measuring the current flowing in each pixel, it is possible to significantly reduce the time for measuring the correction parameter.

Note that, in the method of fabricating the organic EL display apparatus according to the present invention, the display panel is divided into the divided regions. However, it is preferable that the division reflects the luminance inclination due to the variations in the characteristics of the organic EL devices.

Figure 14A:
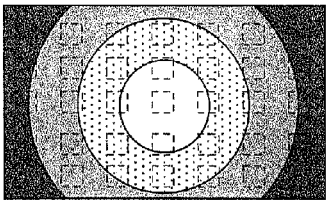
FIG. 14A is a diagram illustrating luminance distribution on the display panel when the light-emitting layer is formed by vapor deposition.

FIG. 14A is a diagram illustrating luminance distribution on the display panel when the light-emitting layer is formed by vapor deposition. When the light-emitting layer is formed by vapor deposition, the thickness of light-emitting layer at the central part of the display unit 113 increases, and it causes a concentric-circular thickness distribution. Accordingly, the light-emitting efficiency and the light-emission starting current value of the organic EL device have a concentric-circular distribution. In this case, by dividing the divided region into the concentric-circular shape as shown in FIG. 14A, consequently, it is possible to obtain highly precise correction parameter for mainly correcting the variation in the driving transistors 204.

Figure 14B:
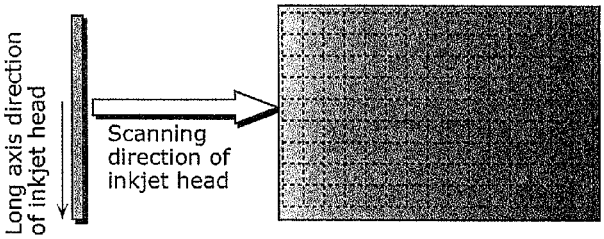
FIG. 14B is a diagram illustrating luminance distribution on the display panel when the light-emitting layer is formed by ink-jet printing.

FIG. 14B is a diagram illustrating luminance distribution on the display panel when the light-emitting layer is formed by ink-jet printing. When scanning the ink-jet head and printing the light-emitting layer on the display unit 113, the light-emitting efficiency changes in the scanning direction due to difference in environment at the time of drying the ink and others. Furthermore, the amount of injection from a nozzle of an ink-jet heat mildly varies in the longitudinal direction of the ink-jet head. Thus, the light-emitting efficiency varies in a direction vertical to the scanning direction. When the distribution of light-emitting efficiency is not monotonous as in this example, it is preferable that the divided region should be divided in small regions. As a result, it is possible to obtain the highly precise correction parameter for mainly correcting the variation in the driving transistor.

Embodiment 2

In Embodiment 2, a case in which the organic EL display apparatus has the display panel to perform display operation using a correction parameter generated by a method of fabricating the organic EL display apparatus according to the present invention.

Figure 15:
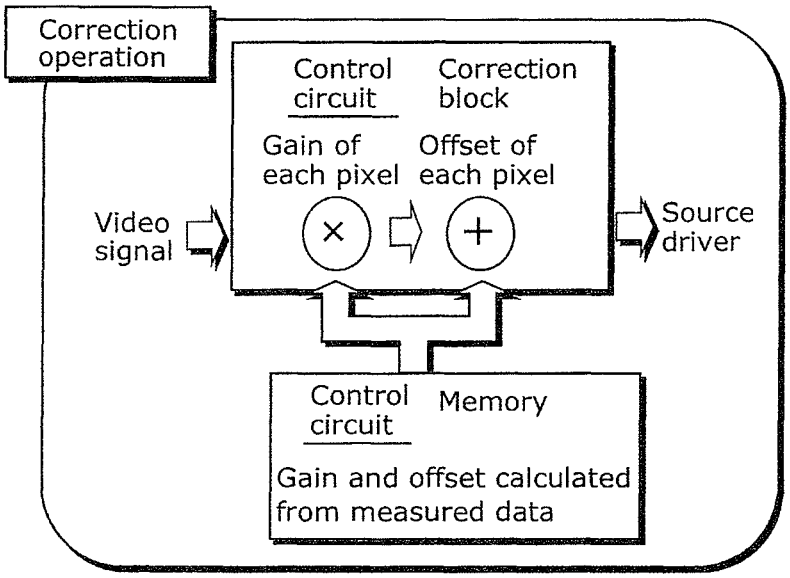
FIG. 15 is a diagram illustrating operation for correcting the voltage gain and offset at the time of display operation of the organic EL display apparatus according to Embodiment 2 of the present invention.

FIG. 15 illustrates the correction operation for the voltage gain and the voltage offset of the organic EL display apparatus 2 according to the present invention at the time of display operation.

The control circuit 12 reads, for example, the correction parameters (voltage gain, voltage offset) stored in Embodiment 1 from the memory 121, and multiply the data voltage corresponding to the video signal with the voltage gain, adds the voltage offset to the multiplied value, and outputs the voltage of the added value to the data line driving circuit 112. This allows the currents flowing in each of the organic EL devices constant with respect to the specified same gray scale, setting a constant current load on the organic EL devices. Accordingly, it is possible to set the current flowing into each organic EL device to be constant, suppressing the variation in the product life of each light-emitting device included in the display panel as time passes. As a result, it is possible to prevent the uneven luminance due to the variations in the product life of the light-emitting device from appearing on screen.

Figure 16:
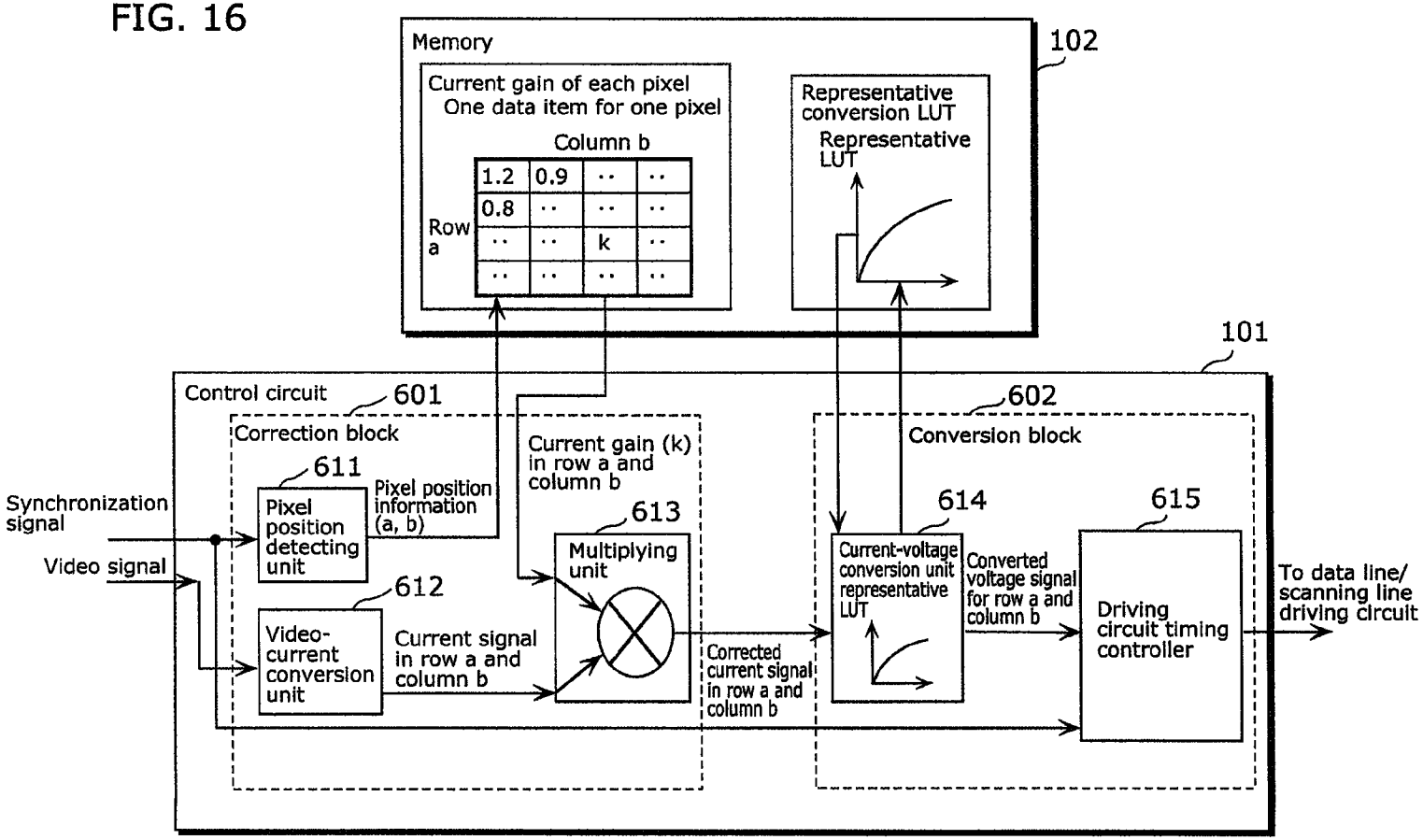
FIG. 16 is a diagram illustrating operation for correcting the current gain at the time of display operation of the organic EL display apparatus according to Embodiment 2 of the present invention.

FIG. 16 illustrates the correction operation for the voltage gain of the organic EL display apparatus according to Embodiment 2 of the present invention at the time of display operation.

The control circuit 101 corrects and converts the video signal input from outside to a voltage signal corresponding to each pixel. The memory 102 stores the current gain and the representative LUT corresponding to each pixel unit.

The control circuit 101 in FIG. 16 includes a correction block 601 and a conversion block 602. When an input of the video signal from outside is received, the correction block 601 reads the current gain (k) in row a, column b from the memory 102 with respect to the input current signal in row a and column b, and corrects the current signal. The conversion block 602 converts the corrected current signal to the voltage signal in row a and column b corresponding to the video signal, based on the representative conversion curve stored in the memory 102. The correction block 601 includes a pixel position detecting unit 611, a video-current conversion unit 612, and multiplying unit 613, and the conversion block 602 includes a current-voltage conversion unit 614 and a driving circuit timing controller 615.

The pixel position detecting unit 611 detects pixel position information of the video signal by a synchronization signal simultaneously input with the video signal input from outside. Here, it is assumed that the detected pixel position is row a and column b.

The video-current conversion unit 612 reads, from the video-current conversion LUT stored in the memory 102 a current signal corresponding to the video signal.

The multiplying unit 613 corrects the current signal by multiplying the current gain corresponding to each pixel unit stored in the memory 102 in Embodiment 1 and the current signal. More specifically, the current gain k in row a and column b is multiplied by the current signal value in row a and column b, generating the current signal in row a and column b after correction.

Note that, the multiplying unit 613 may correct the current signal by a calculation other than multiplication such as a division of the current gain corresponding to each pixel unit stored in the memory 102 in Embodiment 1 by the current signal obtained by converting the video signal input from outside.

The current-voltage conversion unit 614 reads the voltage signal in row a and column b corresponding to the corrected current signal in row a and column b output from the multiplying unit 613 from the representative LUT derived from the representative conversion curve stored in the memory 102.

Finally, the control circuit 101 outputs the converted voltage signal in row a and column b to the data line driving circuit 112 through the driving circuit timing controller 615. The voltage signal is converted to an analog voltage and input to the data line driving circuit, or converted to an analog voltage in the data line driving circuit. Subsequently, the converted signal is supplied to each pixel from the data line driving circuit 112 as the data voltage.

According to Embodiment 2, the video signal input from outside is converted to the current signal for each pixel unit by the correction block 601 and the conversion block 602, and the current signal for each pixel unit is corrected to the predetermined reference current.

After that, the current signal in each pixel unit is converted into a voltage signal, and outputs the converted voltage signal to the driving circuit of the data line.

With this, the data stored for each pixel unit is the current gain corresponding to each pixel unit and the current gain for setting the current of the video signal corresponding to each pixel unit to the predetermined reference current. Accordingly, it is not necessary for preparing a conventional current signal-voltage signal conversion table for converting the current signal corresponding to the video signal to the voltage signal for each pixel unit, and the amount of data prepared for each pixel unit can be significantly reduced. In addition, predetermined information regarding the representative conversion curve indicating the voltage-current characteristics common to the pixel units are held in common with the pixel units. This is a very small amount of data.

Accordingly, it is possible to significantly reduce the amount of data necessary for correcting the current varying for each pixel unit of the display panel to obtain the video signal having the current common to the entire screen. Therefore, the fabricating cost is significantly reduced. As a result, it is possible to reduce the fabricating cost and the processing load at the time of driving, implementing an even display on the entire screen.

Furthermore, the predetermined information indicating the representative conversion curve corresponding to the voltage-current characteristic common to the pixel units is one, common to the pixel unit, and thus the memory capacity can be reduced to minimum.

Here, the current gain used in the correction block 601 is a correction parameter generated in the method of fabricating the organic EL display apparatus according to the present invention and stored in the memory. The representative conversion curve may be the representative I-V characteristic set in step SO1 in the method of fabricating the organic EL display apparatus according to the present invention.

Even when the current gain is set as the correction parameter as illustrated in FIG. 16, it is possible to set the current flowing in the organic EL devices constant with respect to the specified gray scale, setting the current load on the organic EL devices constant. Accordingly, it is possible to set the current flowing into each organic EL device constant, suppressing the variation in the product life of each light-emitting device included in the display panel as time passes.

As a result, it is possible to prevent the uneven luminance due to the variations in the product life of the light-emitting device from appearing on screen.

Although only some exemplary embodiments of the organic EL display apparatus and the method of fabricating the organic EL display apparatus according to the present invention have been described in detail above, those skilled in the art will readily appreciate that many modifications are possible in the exemplary embodiments without materially departing from the novel teachings and advantages of this invention. Accordingly, all such modifications and appliances including the organic EL display apparatus according to the present invention are intended to be included within the scope of this invention.

Figure 17:
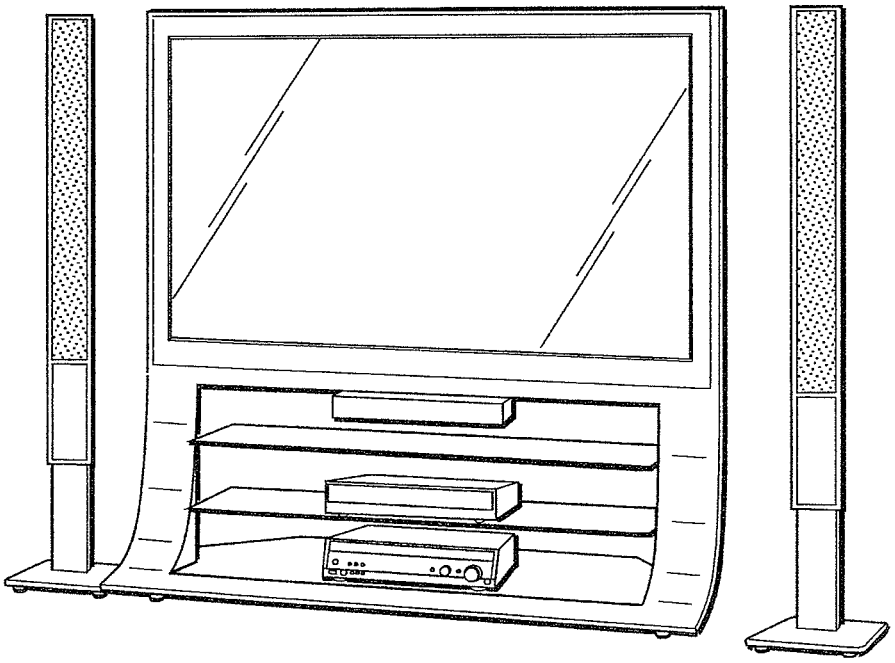
FIG. 17 is an external view of a thin-flat TV incorporating the organic EL display apparatus according to the present invention.
Figure 18:
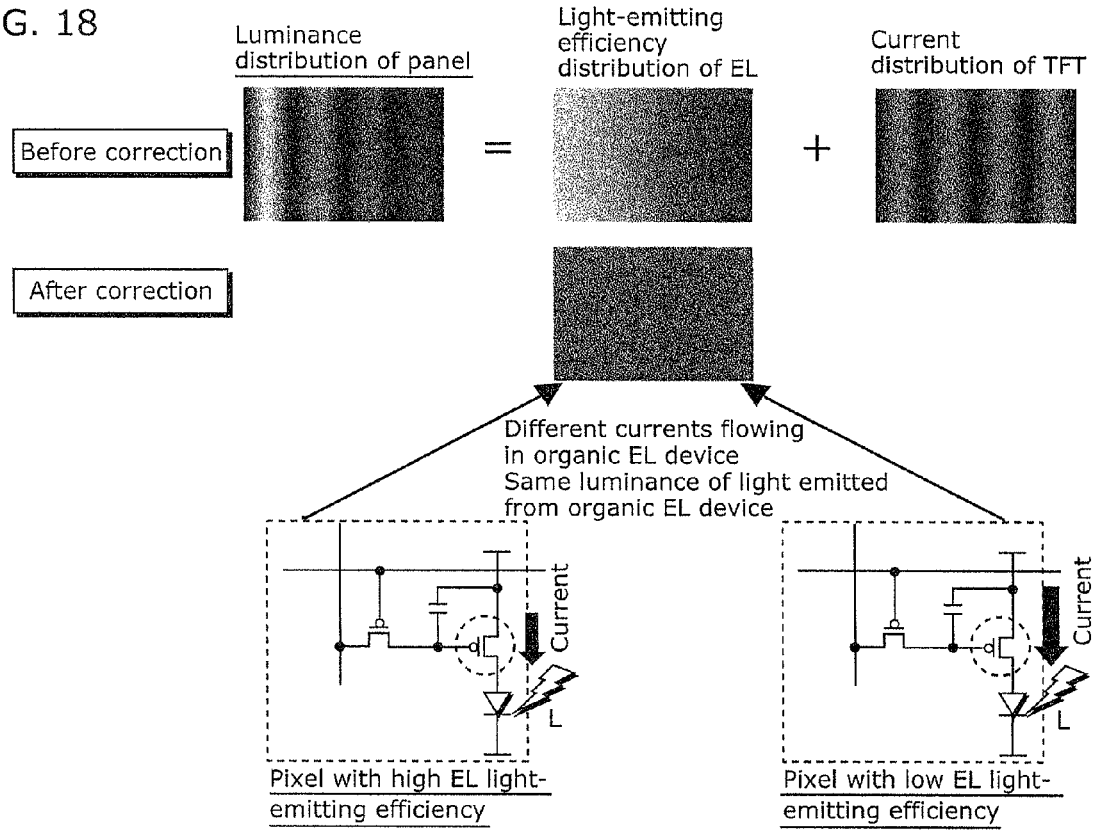
FIG. 18 is a diagram for illustrating the effect of the organic EL display apparatus corrected by the conventional correcting method.

For example, the organic EL display apparatus and the method of fabricating the organic EL display apparatus according to the present invention is incorporated in a thin-flat television as illustrated in FIG. 17. The organic EL display apparatus and the method of fabricating the organic EL display apparatus allows an implementation of low-cost thin flat television having a long-life display with uneven luminance suppressed.

Furthermore, in the embodiments 1 and 2, the term "voltage" in the representative current-voltage characteristics (representative I-V characteristics), the luminance-voltage characteristics (L-V characteristics), and the current-voltage characteristics (I-V characteristics) may not only refer to an analog voltage value, but also a voltage signal representing a gray-scale. More specifically, in the embodiments 1 and 2, the representative current-voltage characteristic (representative I-V characteristic), the luminance-voltage characteristic (L-V characteristic), and the current-voltage characteristic (I-V characteristic) include a representative characteristic between a current and a voltage signal, a characteristic between a luminance and a voltage signal, and a characteristic between a current and a voltage signal, respectively.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

The present invention is particularly useful for an organic EL flat panel display including an organic EL display apparatus, and is suitably used as a display apparatus of a display which requires uniform image quality and the method of fabricating the display apparatus.

What is claimed is:

1. A method of fabricating an organic EL display apparatus, comprising:

obtaining a representative current-voltage characteristic common to an entire display panel including a plurality of pixels each having a light-emitting device and a driving device which is voltage-driven and controls a current supply to the light-emitting device;

dividing the display panel into a plurality of divided regions, mapplying voltage to the driving device in each of the pixels, measuring a current flowing in each of the divided regions and luminance of light emitted from the divided region when the current is flowing in the divided region, calculating a luminance-current characteristic of the divided region according to the measured current flowing in the divided region and the measured luminance of the light emitted from the divided region, and calculating a light-emitting efficiency and a light-emission starting current value for each of the divided regions, the light-emitting efficiency being a reciprocal of a slope of the luminance-current characteristic, and the light-emission starting current value being an intercept of a current axis of the luminance-current characteristic;

measuring luminance of light emitted from each of the pixels in the display panel by a predetermined measuring device and calculating a luminance-voltage characteristic of each of the pixels according to the measured luminance of the light emitted from the pixel;

calculating a current-voltage characteristic of each pixel by dividing each luminance value of the luminance-voltage characteristic calculated for the pixel by light-emitting efficiency of a divided region to which the pixel belongs, and by adding, to the divided value, a light-emission starting current value of the divided region to which the pixel belongs; and calculating a correction parameter for a target pixel such that the current-voltage characteristic of the target pixel calculated in the calculating of a current-voltage characteristic of each pixel is corrected to the representative current-voltage characteristic.

2. The method of fabricating the organic EL display apparatus according to claim 1, wherein, the measuring of luminance of the light emitted from the pixel includes;

applying a predetermined voltage to the pixels included in the display panel such that the pixels emit light simultaneously; and capturing, by a predetermined measuring device, the light simultaneously emitted from the pixels; and in the calculating of a luminance-voltage characteristic, an image obtained by the capturing is obtained, luminance of each of the pixels is determined from the obtained image, and the luminance-voltage characteristic of each of the pixels is calculated using the predetermined voltage and the determined luminance of the pixel.

3. The method of fabricating the organic EL display apparatus according to claim 2, wherein the predetermined measuring device is an image sensor.

4. The method of fabricating the organic EL display apparatus according to claim 2, wherein, in the calculating of a current-voltage characteristic of each pixel, a position of the target pixel in the display panel is determined, and when the target pixel is located near a boundary with another neighboring divided region which does not include the target pixel, the light-emitting efficiency and the light-emission starting current value of the target pixel are calculated by weighting the light-emitting efficiency and the light-emission starting current value of the divided region which includes the target pixel and the light-emitting efficiency and the light-emission starting current value of the other neighboring divided region at a predetermined ratio, and the current-voltage characteristic of each pixel is calculated by dividing the luminance value of the luminance-voltage characteristic of each pixel by the light-emitting efficiency of the target pixel, and by adding the light-emission starting current value of the target pixel to the divided value, in the calculating of a correction parameter, a correction parameter for the target pixel is calculated such that the current-voltage characteristic of the target pixel calculated in the calculating of a current-voltage characteristic of each pixel is corrected to the representative current-voltage characteristic.

5. The method of fabricating the organic EL display apparatus according to claim 4, wherein, in the calculating of a current-voltage characteristic of each pixel, when calculating the light-emitting efficiency and the light-emission starting current value of the target pixel, the closer the target pixel to the boundary with the other neighboring divided region, the higher a ratio of the light-emitting efficiency and the light-emission starting current value of the other neighboring divided region used for the weighting.

6. The method of fabricating the organic EL display apparatus according to claim 5, wherein, in the calculating of a current-voltage characteristic of each pixel, when calculating the light-emitting efficiency and the light-emission starting current value of the target pixel, the light-emitting efficiency and the light-emission starting current value of the target pixel are calculated according to a ratio between a distance from the target pixel to the center of the divided region including the target pixel and a distance from the target pixel to the center of each of the other neighboring divided region.

7. The method of fabricating the organic EL display apparatus according to claim 1, wherein, in the calculating of a light-emitting efficiency and a light-emission starting current value, the light-emitting efficiency and the light-emission starting current value calculated in a method of fabricating another organic EL display apparatus fabricated under a same condition is used as the light-emitting efficiency and the light-emission starting current value of each of the divided regions.

8. The method of fabricating the organic EL display apparatus according to claim 1, wherein, in the obtaining of a representative current-voltage characteristic, a representative current-voltage characteristic obtained in a method of fabricating another organic EL display apparatus fabricated under a same condition is used as the representative current-voltage characteristic.

9. The method of fabricating the organic EL display apparatus according to claim 1, further comprising writing, on a predetermined memory used for the display panel, the correction parameter for each pixel calculated in the calculating of a correction parameter.

10. The method of fabricating the organic EL display apparatus according to claim 1, wherein, in the obtaining of a representative current-voltage characteristic, a plurality of voltages are applied to a plurality of pixels to be measured to flow current in the pixels to be measured, the current flowing in each of the pixels to be measured is measured for each of the voltages, and the representative current-voltage characteristic is calculated by averaging the current-voltage characteristics of the pixels to be measured.

11. The method of fabricating the organic EL display apparatus according to claim 1, wherein, in the obtaining of a representative current-voltage characteristic, a plurality of common voltages are simultaneously applied to the pixels to be measured to flow current in each of the pixels to be measured, a sum of the current flowing in the pixels to be measured is calculated for each of the common voltages, and the representative current-voltage characteristic is calculated by dividing the sum of the current flowing in the pixels to be measured by the number of the pixels to be measured.

12. The method of fabricating the organic EL display apparatus according to claim 1, wherein a correction parameter includes a parameter indicating a ratio of a voltage of the current-voltage characteristic of the target pixel calculated in the calculating of a current-voltage characteristic to a voltage of the representative current-voltage characteristic.

13. The method of fabricating the organic EL display apparatus according to claim 1, wherein a correction parameter includes a parameter indicating a ratio of a current of the current-voltage characteristic of the target pixel calculated in the calculating of a current-voltage characteristic to a current of the representative current-voltage characteristic.

14. The method of fabricating the organic EL display apparatus according to claim 1, wherein a correction parameter includes a parameter indicating a difference between a voltage of the current-voltage characteristic of the target pixel calculated in the calculating of a current-voltage characteristic and a voltage of the representative current-voltage characteristic.

15. The method of fabricating the organic EL display apparatus according to claim 1, wherein the representative current-voltage characteristic, the luminance-voltage characteristic, and the current-voltage characteristic are a representative characteristic between a current and a voltage signal, a characteristic between a luminance and a voltage signal, and a characteristic between a current and a voltage signal, respectively.

16. An organic EL display apparatus comprising:

a plurality of pixels each including a light-emitting device and a driving device for controlling a current supply to the light-emitting device;

a plurality of data lines for supplying a signal voltage to each of the pixels;

a plurality of scanning lines for supplying a scanning signal to each of the pixels;

a data line driving circuit for supplying the signal voltage to the data lines;

a scanning line driving circuit for supplying the scanning signal to the scanning lines;

a storage unit configured to store predetermined correction parameters for each of the pixels; and a correction unit configured to read, from the storage unit, the predetermined correction parameters corresponding to each of the pixels to correct the video signal corresponding to each of the pixels, when an input of a video signal is provided from outside, wherein the predetermined correction parameters are generated by the following:

obtaining a representative current-voltage characteristic common to an entire display panel including the pixels;

dividing the display panel into a plurality of divided regions, applying voltage to the driving device in each of the pixels, measuring a current flowing in each of the divided regions and luminance of light emitted from the divided region when the current is flowing in the divided region, calculating a luminance-current characteristic of the divided region, and calculating a light-emitting efficiency and a light-emission starting current value for each of the divided regions, the light-emitting efficiency being a reciprocal of a slope of the luminance-current characteristic, and the light-emission starting current value being an intercept of a current axis of the luminance-current characteristic;

measuring luminance of light emitted from each of the pixels in the display panel by a predetermined measuring device and calculating a current-voltage characteristic of each of the pixels;

calculating a current-voltage characteristic of each pixel by dividing each luminance value of the luminance-voltage characteristic calculated for the pixel by light-emitting efficiency of a divided region to which the pixel belongs, and by adding, to the divided value, a light-emission starting current value of the divided region to which the pixel belongs; and calculating a correction parameter for a target pixel for correcting the current-voltage characteristic of the target pixel to the representative current-voltage characteristic.

* * * * *